US005595042A

United States Patent [19]

Cappi et al.

[11] Patent Number: 5,595,042

[45] Date of Patent: Jan. 21, 1997

[54] PROCESS AND MACHINE FOR WRAPPING PRODUCTS WITH STRETCHABLE FILM, AND WRAPPING FORMED BY THIS PROCESS

[75] Inventors: Angelo Cappi, Vignola; Renato Rimondi, Bazzano, both of Italy

[73] Assignee: A.W.A.X. Progettazione E Ricerca S.r.L., Vignola, Italy

[21] Appl. No.: 646,641

[22] Filed: May 8, 1996

Related U.S. Application Data

[62] Division of Ser. No. 215,646, Mar. 22, 1994, Pat. No. 5,528,881.

[30] Foreign Application Priority Data

Mar. 24, 1993 [IT] Italy ..... GE93A0028

[51] Int. Cl.[6] ..... B65B 11/00; B65B 53/00

[52] U.S. Cl. ..... 53/66; 53/64; 53/556; 53/228

[58] Field of Search ..... 53/556, 228, 230, 53/232, 222, 223, 64, 66

[56] References Cited

U.S. PATENT DOCUMENTS

| | | | |
|---|---|---|---|
| 3,662,513 | 5/1972 | Fabbri | 53/463 |
| 3,967,433 | 7/1976 | Bonfiglioli . | |
| 4,505,092 | 3/1985 | Bowers | 53/556 |
| 4,583,348 | 4/1986 | Treiber et al. | 53/556 |
| 4,674,269 | 6/1987 | Denda . | |
| 4,709,531 | 12/1987 | Denda . | |
| 4,958,479 | 9/1990 | Treiber et al. | 53/556 |

FOREIGN PATENT DOCUMENTS

| | | |
|---|---|---|
| 0092759 | 11/1983 | European Pat. Off. . |
| 0569615 | 11/1992 | European Pat. Off. . |
| 1297849 | 11/1972 | United Kingdom . |

*Primary Examiner*—Linda Johnson
*Attorney, Agent, or Firm*—Larson and Taylor

[57] ABSTRACT

A portion of film, with a length proportionate to the dimensions and to the characteristics of the product to be wrapped, is subjected to a transverse pre-stretching, the extent of which is also proportionate to the said parameters. The film is held at one end by a fixed dispenser (30) and at the other end by a movable rear clamp (61), which conveniently reduce the longitudinal tension of the film, both in pre-stretching and during the subsequent lifting of the product. In this phase, the side clamps (78-178) approach each other to reduce the pre-stretching, and are then inserted under the product and are opened, to extend the side flaps of the film under the product. This is followed by the operation, as a group, of the rear folder (52), which extends under the product a portion of the film held by the associated rear clamp (61), and the pusher (55) which pushes the product on to the front folder (37), while a final flap of film is drawn from the fixed dispenser (30), is extended over the whole length of the bottom of the product, is cut to size, and is disposed under the side flaps and the rear flap, which has been released at the correct time by the said rear clamp.

30 Claims, 17 Drawing Sheets

PROCESS AND MACHINE FOR WRAPPING PRODUCTS WITH STRETCHABLE FILM, AND WRAPPING FORMED BY THIS PROCESS

This is a division of application Ser. No. 08/215,646 filed Mar. 22, 1994, now U.S. Pat. No. 5,528,881.

In order to reconcile the necessities of display and packaging of products, particularly in the field of foodstuffs, there is a known way of making a lightweight packaging consisting of a tray made of cardboard or expanded polystyrene or other suitable material, which holds the product visibly and which is wrapped together with it in a stretchable transparent film made of suitable plastic material, commonly known as "stretch film".

There are known processes and machines which carry out the said packaging automatically, without subjecting the stretchable film to a previous phase of tensioning or pre-stretching.

There are also known processes and machines which subject the stretchable film to pre-stretching before forcing the product against it, so as to take maximum advantage of the characteristics of stretchability of the film used. These processes permit the wrapping of products having dimensions which vary over a wide range, without changing the width of the film used, and also permit the reduction of the differential tensions in the film in contact with the product, ensuring greater strength of the film and more delicate treatment of the packaged product. A machine operating according to this principle is described, for example, in U.S. Pat. No. 3, 967,433 and in Italian patent application No. GE91A000024.

The object of the invention consists in improvements to these types of processes and machines, to obtain the following advantages:

- the maximum economy in the use of the wrapping film, by automatically feeding into the cycle a portion of film having a length made proportionate from time to time to the dimensions of the product to be wrapped, and then by subjecting this portion of film to a proportionate prestretching in the transverse direction, the extent of which is as great as possible but always proportionate to the dimensions of the product, without introducing anomalous tensions into the film. For this purpose, the longitudinal tension of the film is made to diminish automatically during the transverse pre-stretching, as a function of the extent of the transverse pre-stretching and consequently as a function of the dimensions of the product to be wrapped;
- the length of the portion of fill subject to the transverse pre-stretching is automatically made proportionate to the dimensions of the product to be wrapped, so as to avoid excessive and uncontrollable accumulations of film in the bottom corner areas of the product;
- in the phase of wrapping of the product, the prestretching is reduced automatically and in a balanced way, as a function of the dimensions of the product, to avoid anomalous tensions in the wrapping film and tow rap even very fragile products without damage;
- the folding of the flaps of the wrapping fill on to the bottom of the tray containing the wrapped product is made to take place in an ordered way rather than in a random and uncontrolled way as in conventional processes and machines, to provide an aesthetically pleasing package suitable for the execution of a perfect and uniformly distributed weld;
- the flaps of the wrapping film disposed in the lower part of the tray containing the wrapped product are less stretched and can therefore react uniformly and without risk of tearing during the welding which fixes the said flaps together at the end of each wrapping cycle. This condition and that described in the preceding item permit the provision of a sealed package, particularly suitable for products, such as meat, which may release liquids;
- the conditions described in the preceding items are provided with limited means which are easily constructed and driven, are highly reliable, and can operate on products of various dimensions and characteristics, without the need for adjustments and/or inspection by qualified personnel, and consequently in a fully automatic way.

These and other advantages are achieved with the following process. It should be stated initially that the terms "front" and "rear" used below refer to the direction of advance of the product towards the discharge area of the machine. The terms "placed under" and "superimposed" used for the flaps of film extended on to the bottom of the product refer to the effective reciprocal position of these flaps with respect to the vertical, so that one flap is, for example, considered to be placed under another when it is located beneath it. A portion of the fill, having a length proportionate to the dimension of the product which is aligned longitudinally with the film, is extended horizontally under the lifter which carries the product to be wrapped. The film is extended longitudinally but is not stretched. The leading end of the film is held by a rear clamp associated with the underlying movable rear folder of the machine, while the other end of the film, still joined to the supply reel, is controlled by a comb-like dispenser fixed under the front folder, which is also fixed, of the machine, in relation to which folder the product to be wrapped has a fixed reference point in the transfer to the lifter.

The travel of the rear folder with the rear film holding clamp, and consequently the distance between this mechanism and the front fixed folder, varies according to the dimensions of the product to be wrapped.

Each of the clamps which grip the film laterally consists of a plurality of adjacent clamps, designed to be able to grip portions of film of different lengths which are directly proportionate to the dimensions of the product to be wrapped. The smaller the product, the shorter will be the length of the portion of film gripped by the side clamps.

A first phase of the wrapping cycle consists in the gripping, by the said clamps, of the sides of a portion of film whose length is proportionate to the dimensions of the product to be wrapped. This portion of film is then pre-stretched transversely according to the dimensions of the product to be wrapped. If an appropriate and/or suitably treated film is used, the prestretching may be of the order of 100–200% or more of the width of the film present at the wrapping point. When these pre-stretching values are used, the pre-stretched side flaps are joined to the original film by corner areas characterized by a small radius of curvature, a condition which prevents subsequent excessive and random accumulation of film in the comer areas of the product carrying tray to be wrapped.

While the pre-stretching is being carried out, the longitudinal tension of the film is automatically diminished by a suitable approach of the rear clamp and by a suitable drawing of film from the fixed dispenser.

In the next phase, the product is lifted against the transversely pre-stretched film, while the side clamps approach each other with a self-centring movement and with a displacement which is a function of the dimensions of the product and of its characteristics of deformability under compression, in order to reconcile the following requirements: keeping the film stretched, while preventing the development of localized excessive tensions in it which might tear it and preventing the crushing of the wrapped product. These conditions are also made possible by the fact that, while the product is lifted against the film, the latter is free to react longitudinally since it is still joined to the feed reel through the dispenser, and since the rear clamp also moves through a correct distance towards the product.

The side clamps are then made to approach each other to the maximum extent, and are opened at the correct time to extend the side flaps of the wrapping film under the product. In this phase the product is kept pushed downwards by a presser above it, and the side clamps cause the hocking down of the oscillating supports of the lifter which then descends.

At this point, the rear folder comes into action and extends under the side flaps of the wrapping and under the product carrying tray, the portion of the rear flap of film still being held by the rear clamp. On the carriage of the rear folder there is also mounted the pusher which, coming into contact with the product carrying tray, pushes it towards the fixed front folder.

When the product carrying tray is sufficiently supported by the front folder, before the rear folder reaches the end of its active travel, the side clamps move away from each other and beyond the transverse extent of the wrapping film.

While the product carrying tray is pushed on to the front folder, a correct quantity of film is drawn from the underlying fixed dispenser and is extended under the side flaps of the wrapping and under the product carrying tray. Before the rear folder reaches the front folder, the rear clamp is made to open and is lowered in order to interact with the dispenser, while the rear folder accompanies the rear flap on to the front folder which extends on to the bottom of the product the said front flap, drawn with the correct tension from the dispenser and applied progressively to the whole length of the product. At the correct time, the front flap is cut by a means operating immediately downstream of the dispenser, after which the new end of the film is gripped by the rear clamp which then withdraws, together with the rear folder and pusher, extending at the wrapping point a portion of film of length proportionate to the dimensions of the next product to be wrapped. The previously wrapped product is transferred from the front folder to the welding conveyor which then removes it.

With the process described, there is disposed on the bottom of the product carrying tray, over its whole length, a flap of substantially unstretched film, correctly superimposed on the other flaps which have also undergone little stretching, so that the assembly of superimposed flaps of the wrapping can react uniformly and in the most favourable way to the fixing welding and can provide a sealed closure of the said wrapping.

Further characteristics of the invention, and the advantages derived therefrom, will be clearly understood from the following description of a preferred embodiment of the invention, illustrated solely by way of example and without restriction in the figures on the fifteen attached sheets of drawings, in which FIG. 1 is a side view of the machine in section along the median axis;

Figure 6A:
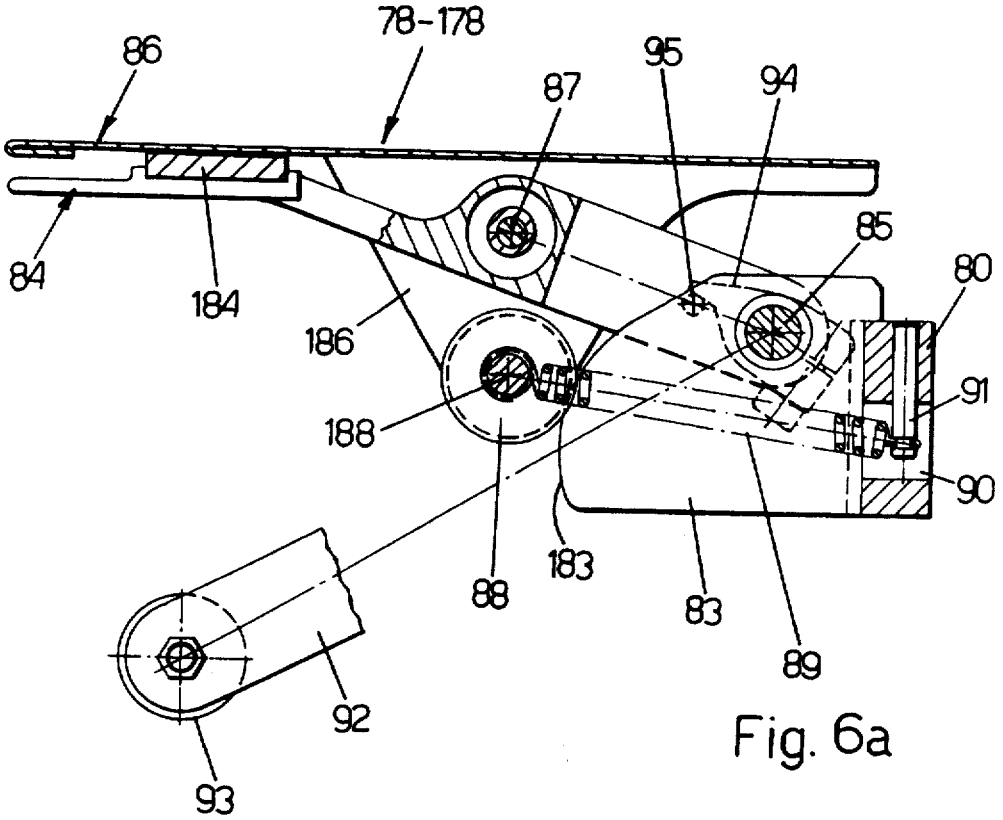
Figure 6B:
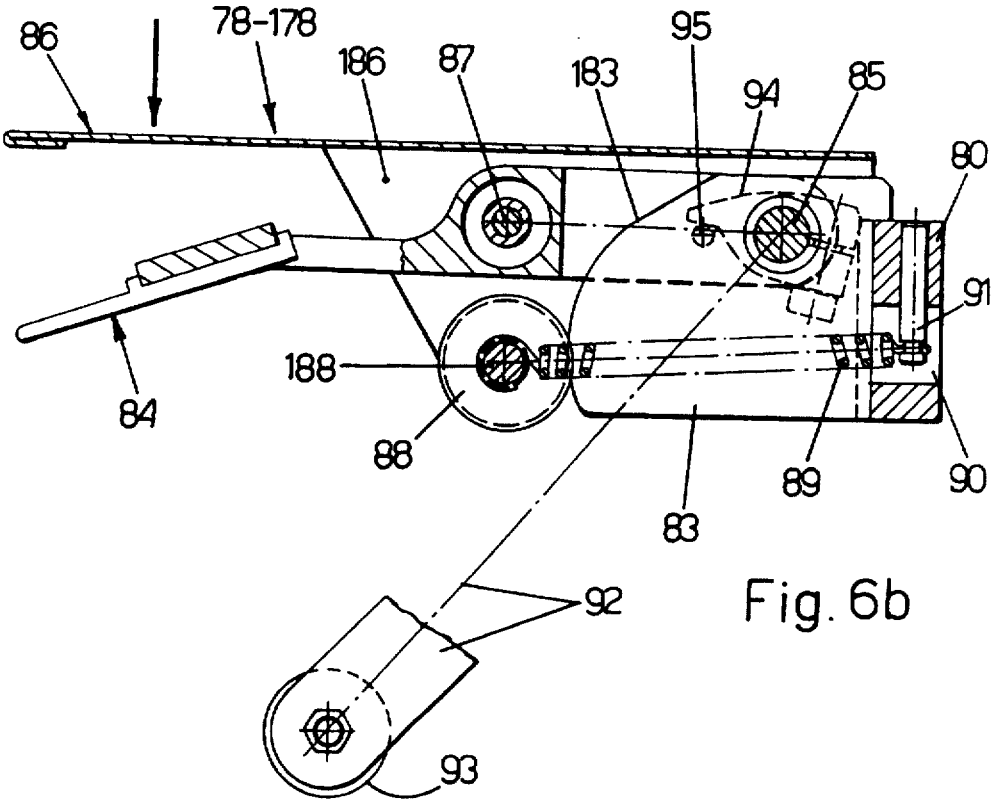
Figure 7:
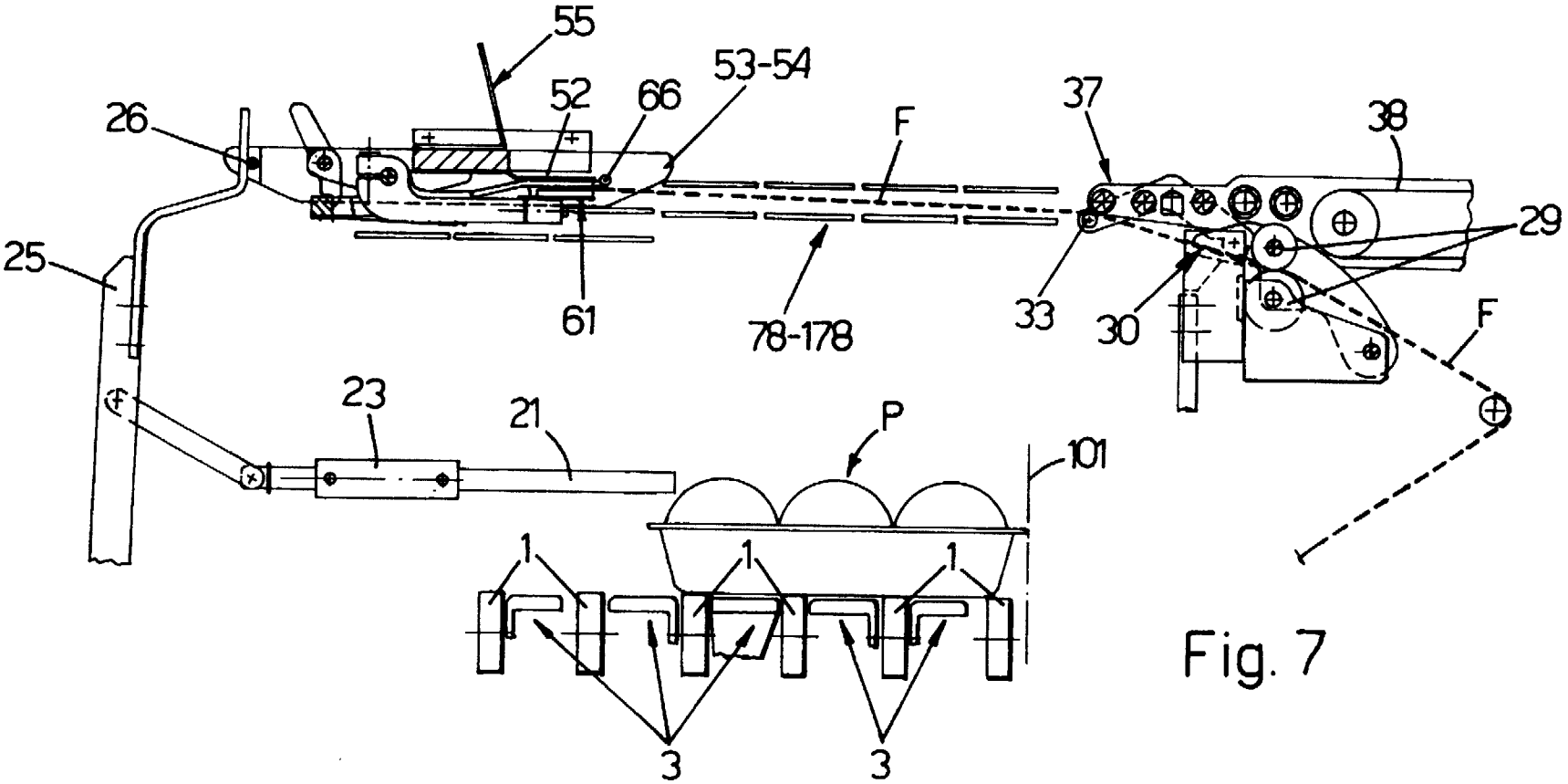
Figure 8:
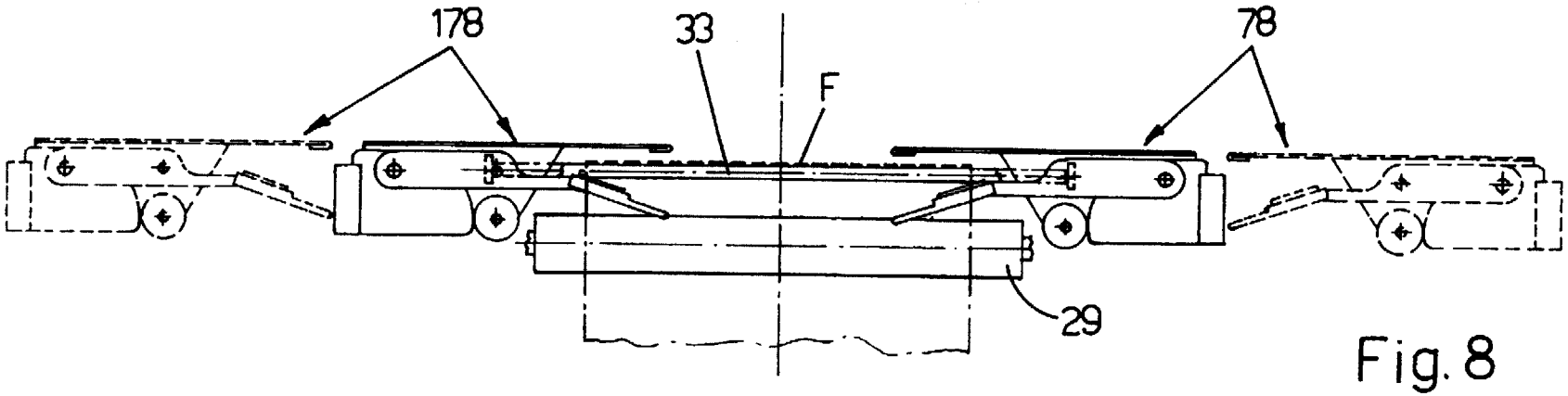
Figure 9:
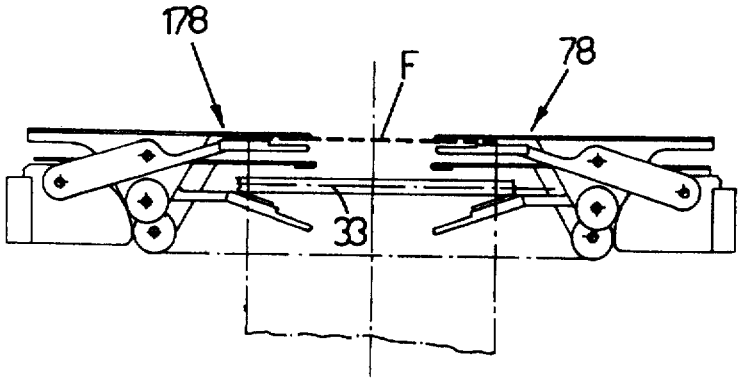
Figure 14:
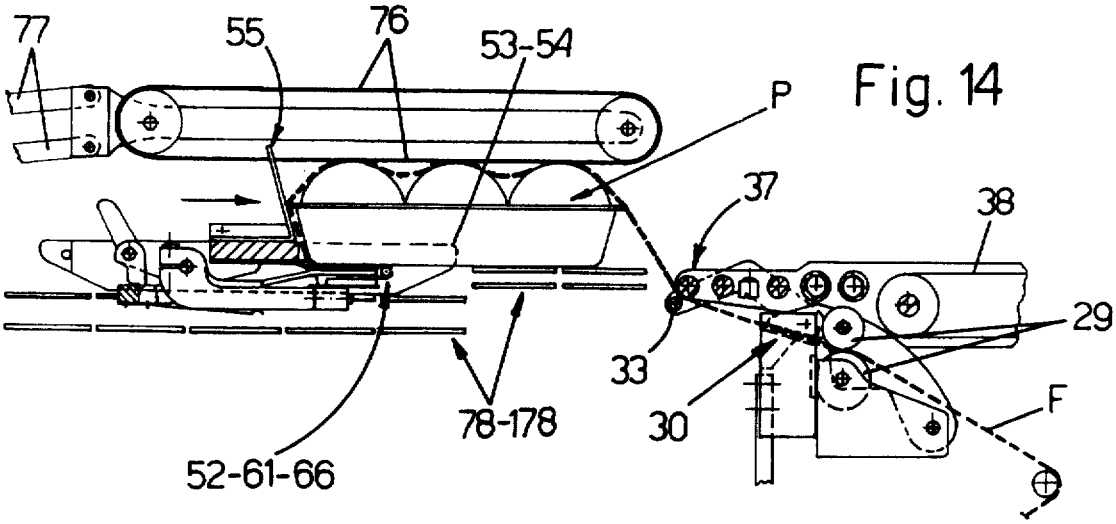
Figure 10:
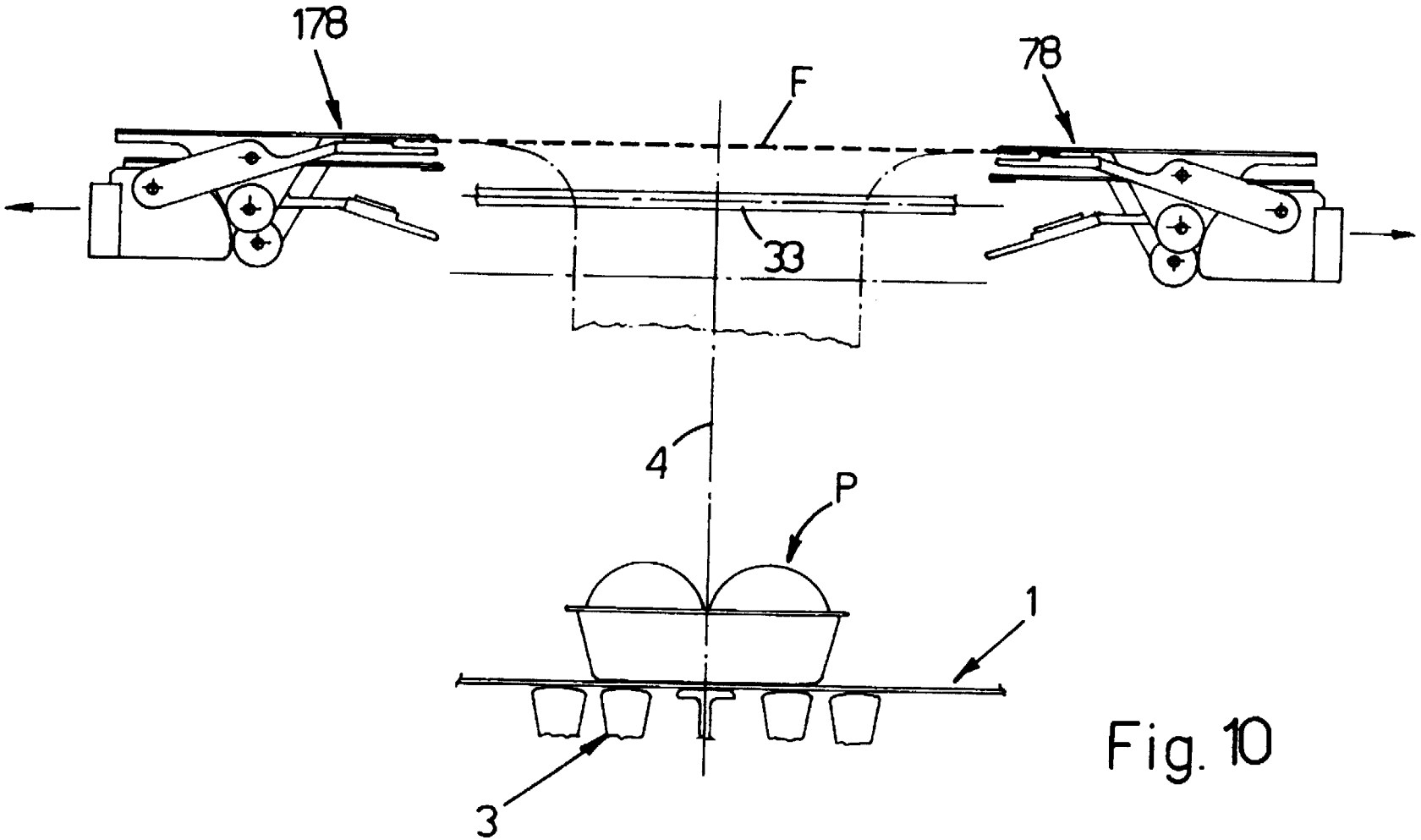
Figure 11:
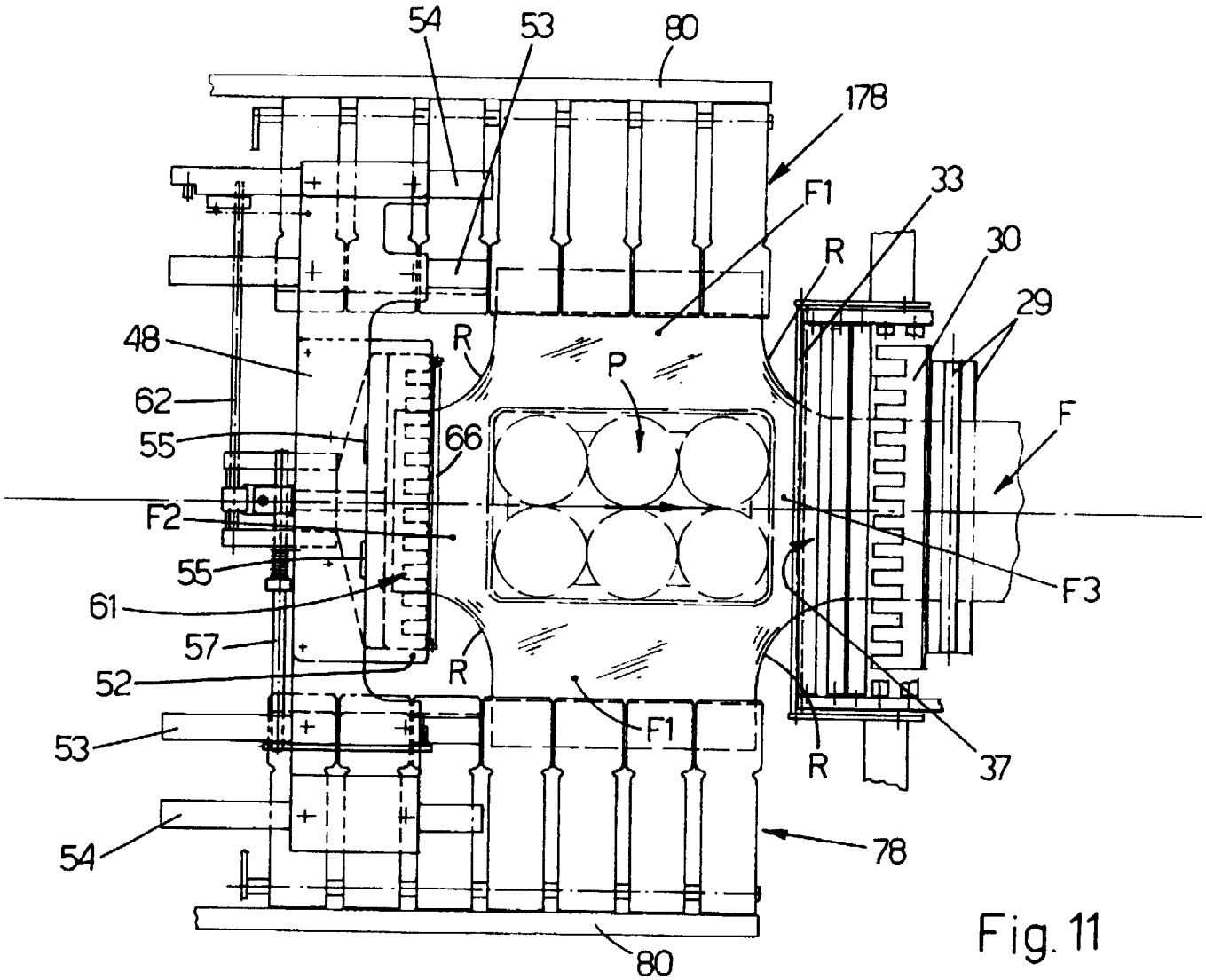
Figure 12:
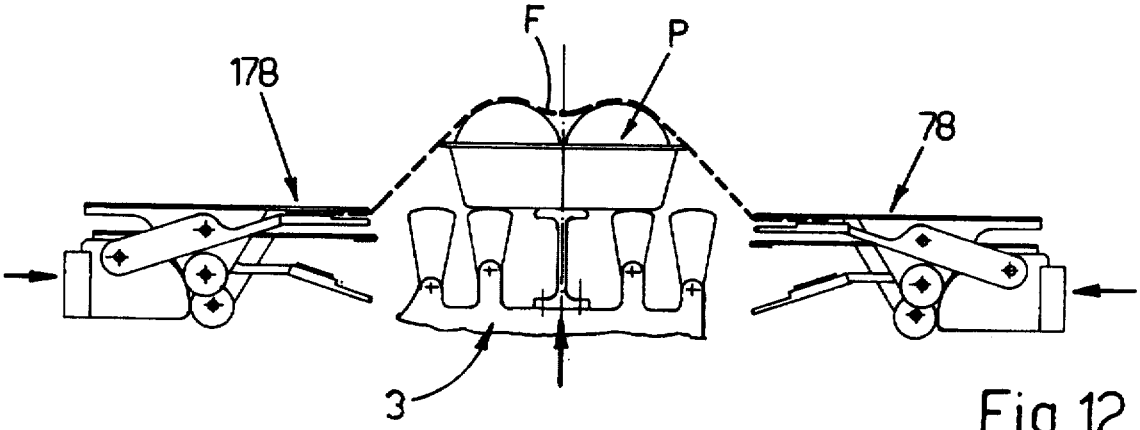
Figure 13:
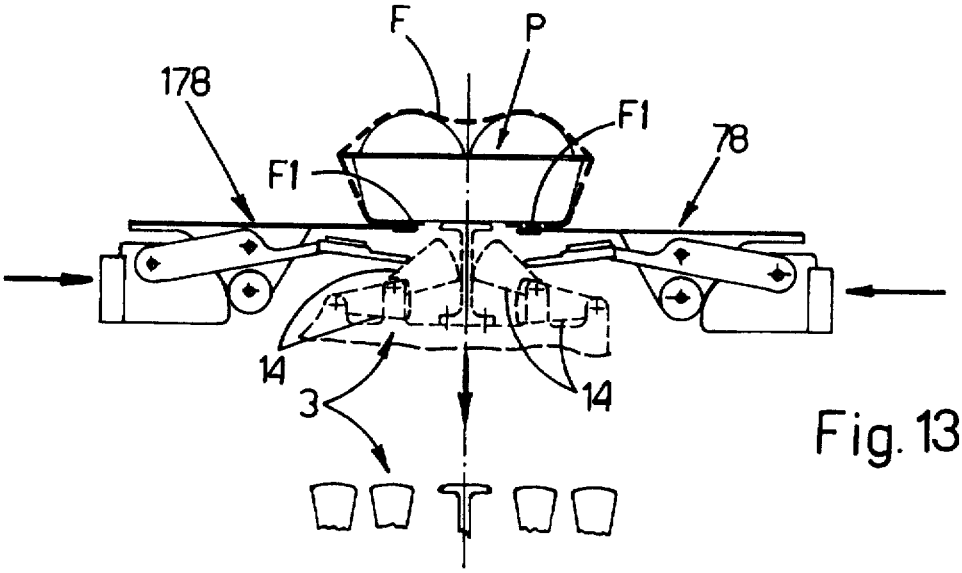
Figure 15:
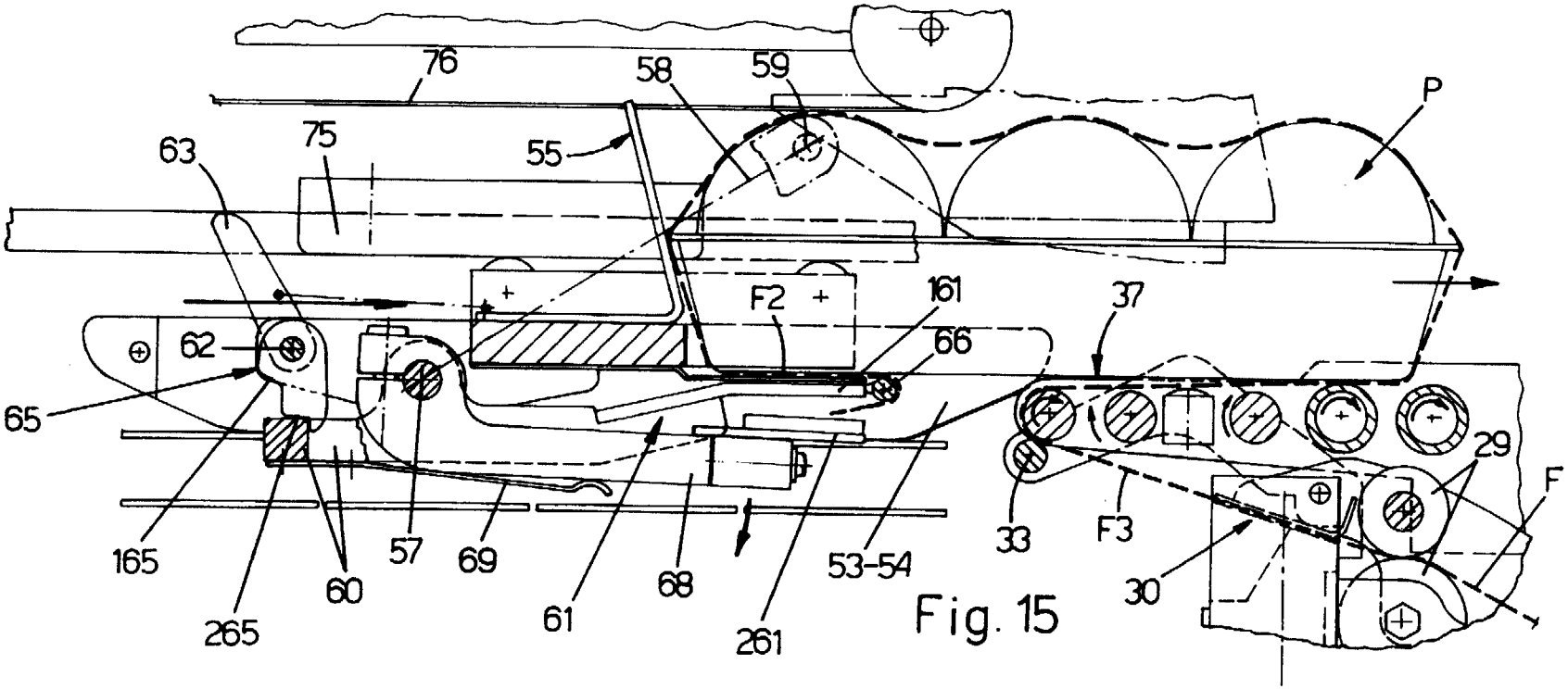
Figure 16:
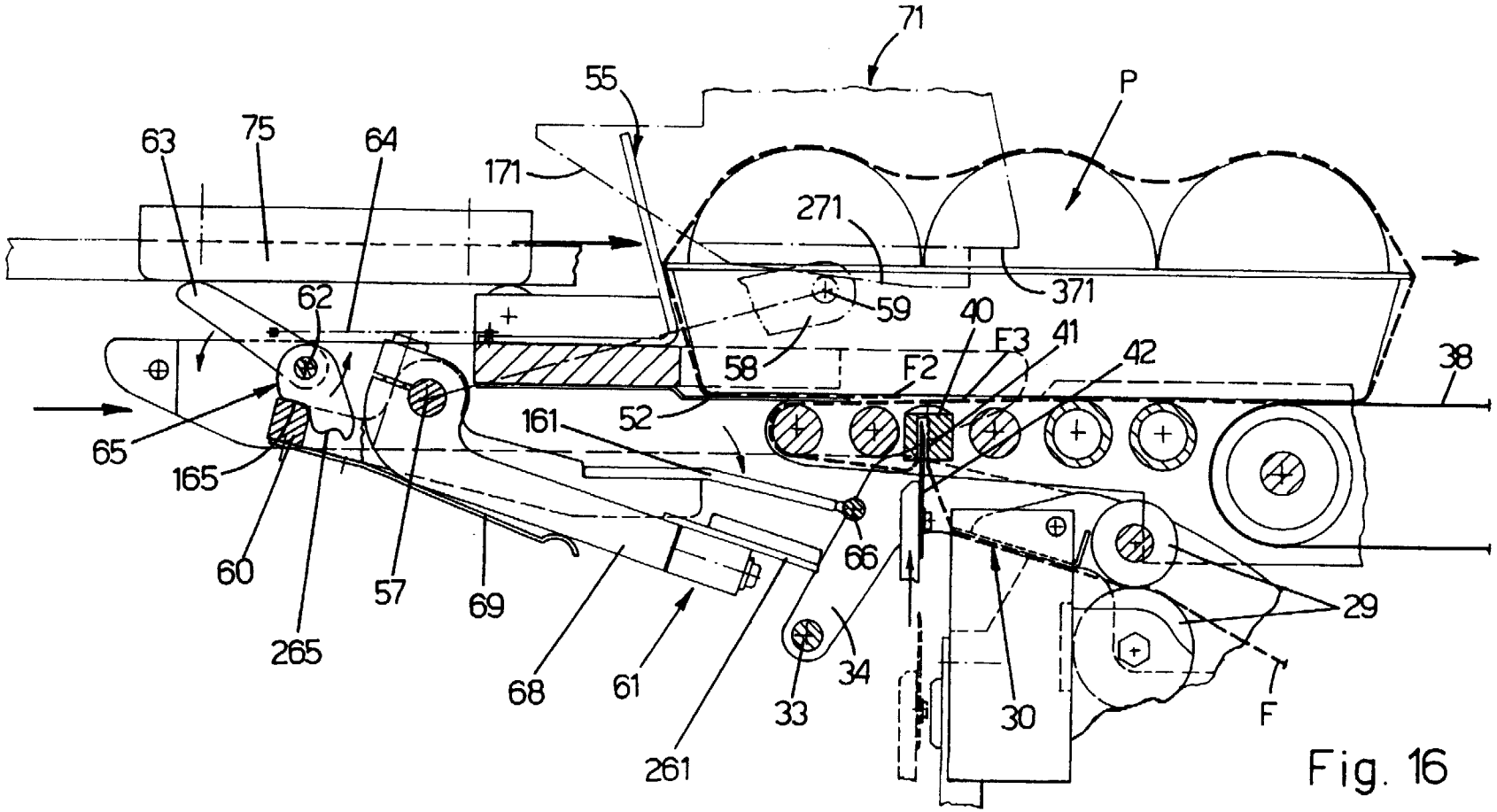
Figure 17:
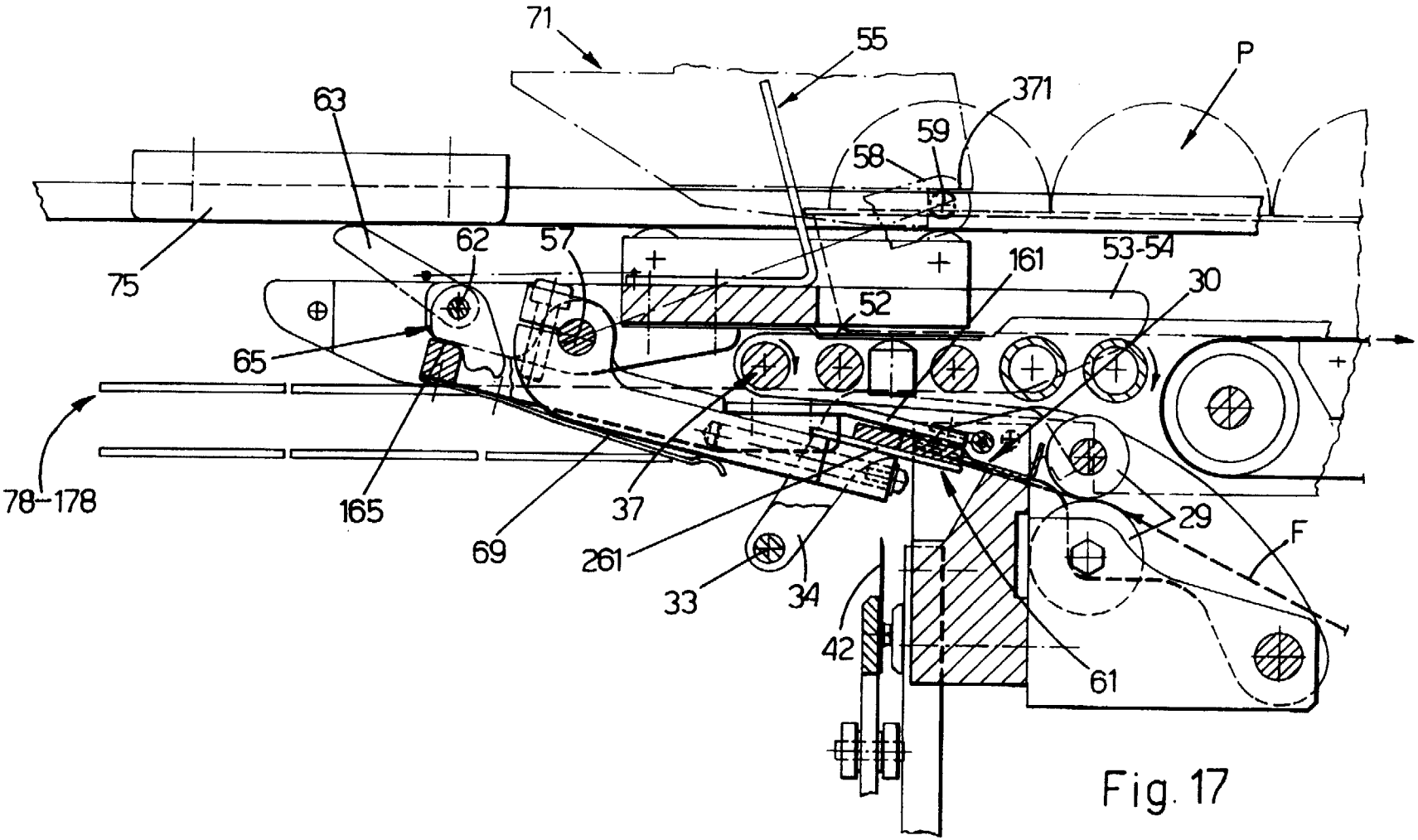
Figure 18:
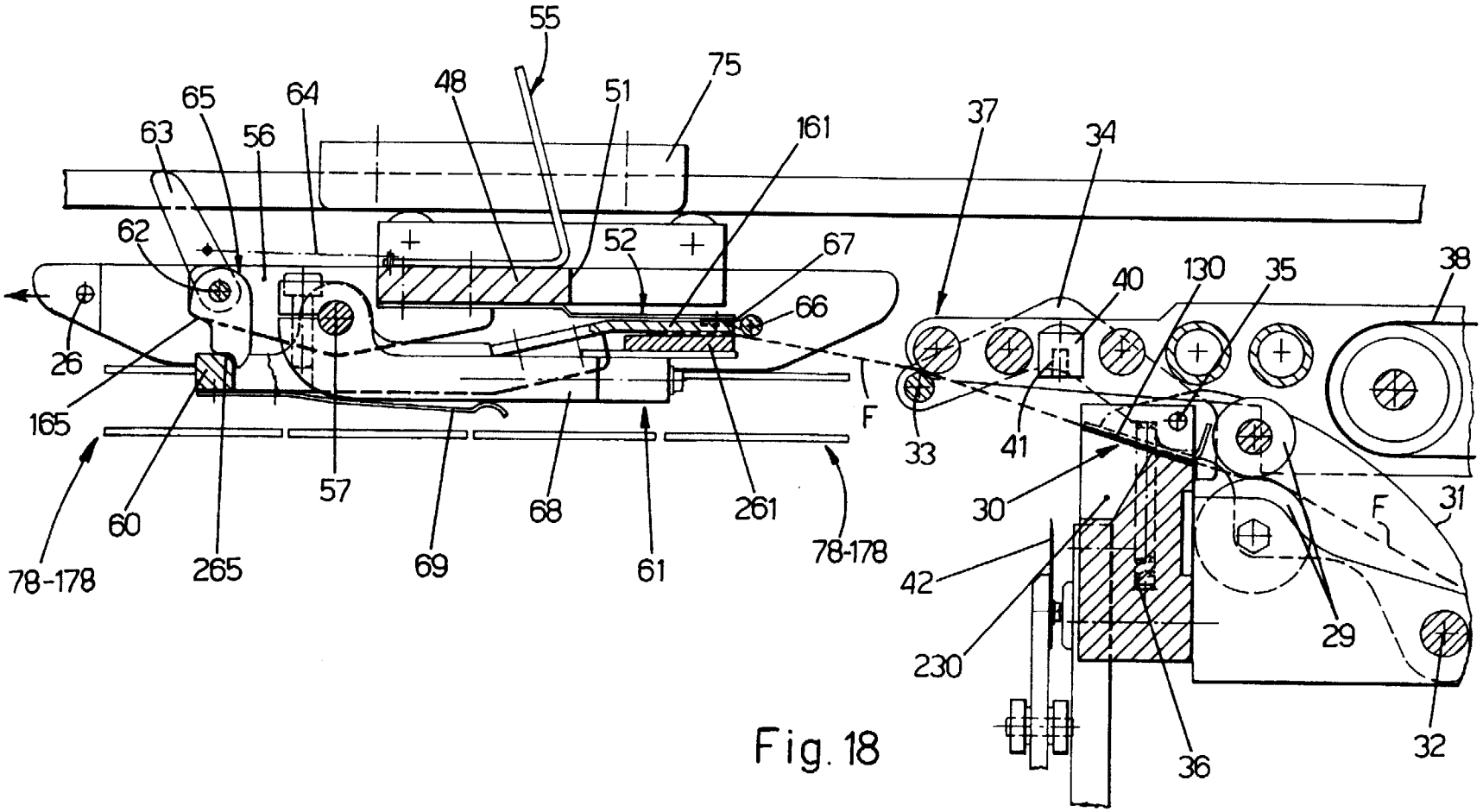
Figure 19:
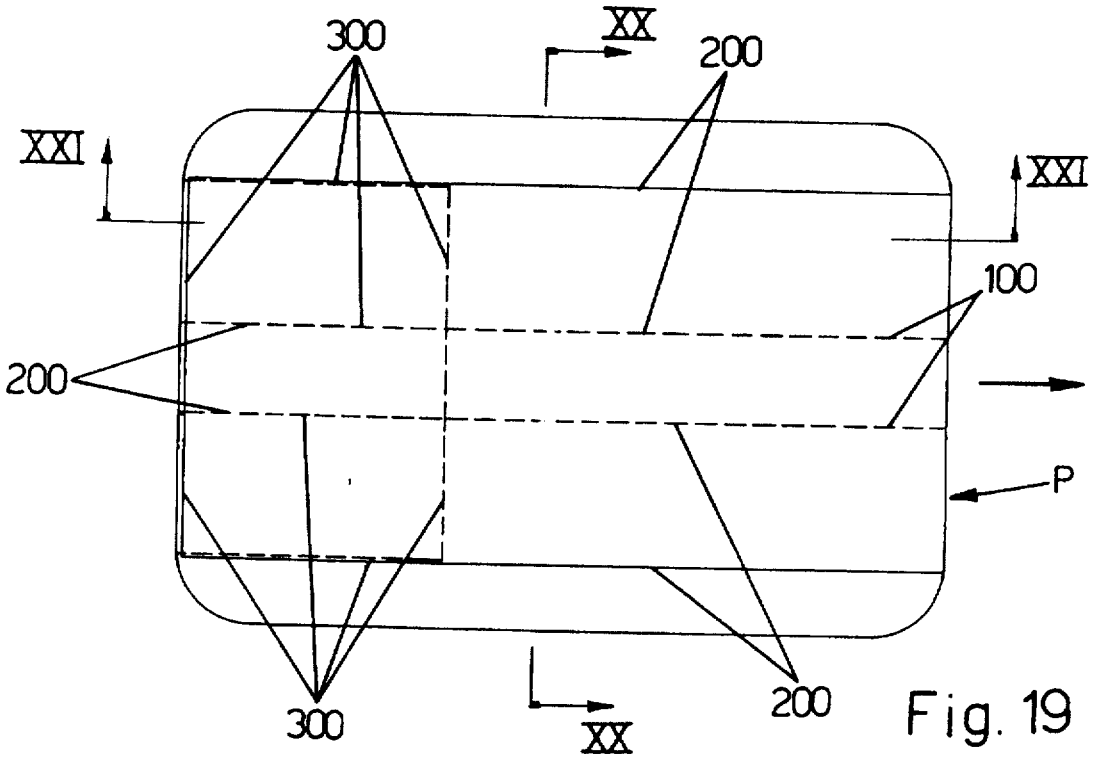
Figure 20:
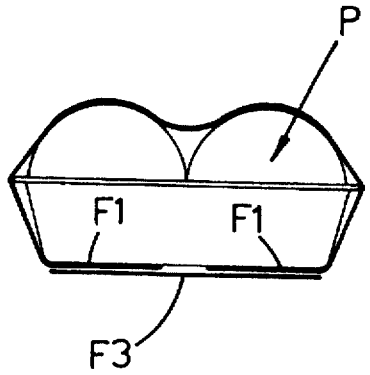
Figure 21:
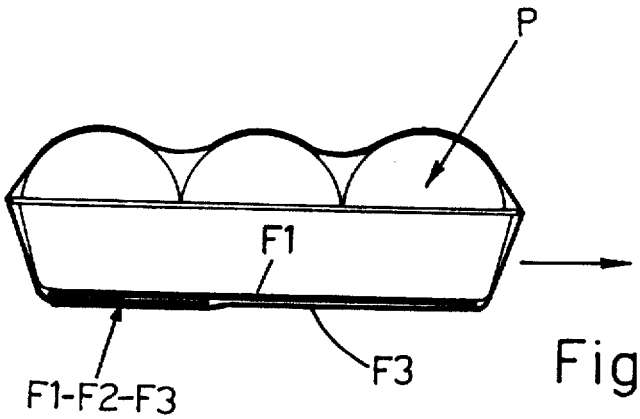

FIGS. 6*a* and 6*b* show an enlargement, from the side and in partial section, of one of the side clamps in the closed and open positions respectively;

FIG. 7 is a side view of the principal parts of the machine, at the end of one operating cycle and at the start of the next cycle;

FIG. 8 is a transverse view of the machine in the condition shown in FIG. 7;

FIGS. 9 and 10 are transverse views of the machine, with the side clamps in the phase of gripping the film and in that of transverse pre-stretching of the film;

FIG. 11 is a plan view from above of the machine during the phase of transverse pre-stretching of the wrapping film;

FIGS. 12 and 13 are transverse views of the machine during the phase of lifting of the product against the pre-stretched film and in the subsequent phase of folding of the side flaps of the wrapping film on to the bottom of the said products FIG. 14 is a side view of the machine during the operation of the rear folder, pusher, and rear clamp assembly;

FIGS. 15, 16 and 17 show the machine from the side, with parts enlarged, and during subsequent and concluding phase, of the product wrapping cycle;

FIG. 18 shows the machine from the side in the return phase of the pusher, rear folder, and rear clamp assembly, for the preparation of the portion of film for the subsequent wrapping cycles FIG. 19 is a plan view from below of the wrapped product;

FIGS. 20 and 21 show the wrapped product in FIG. 19 in section along the line XX—XX and XXI—XXI respectively.

Figure 1:
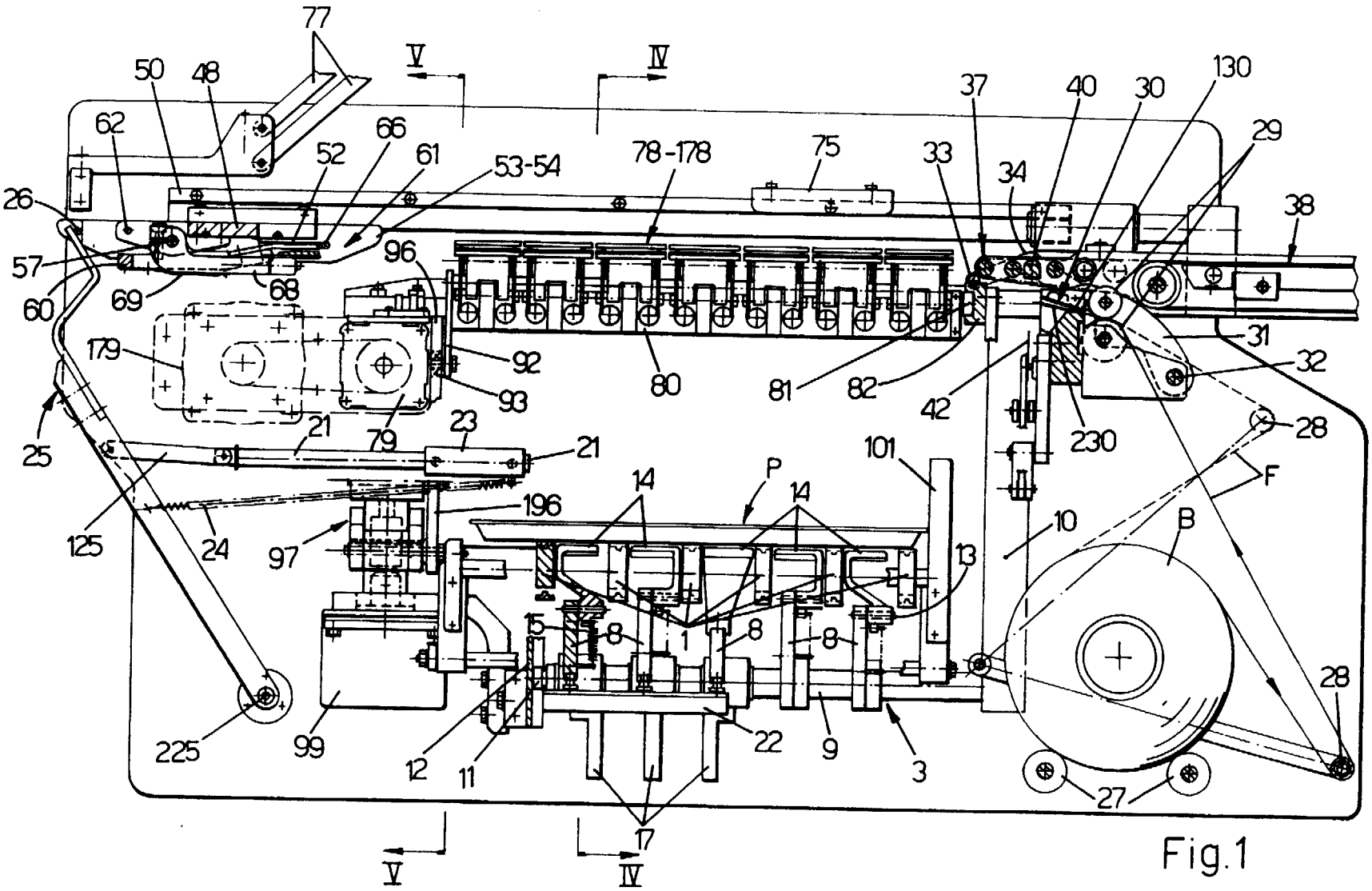
Figure 2:
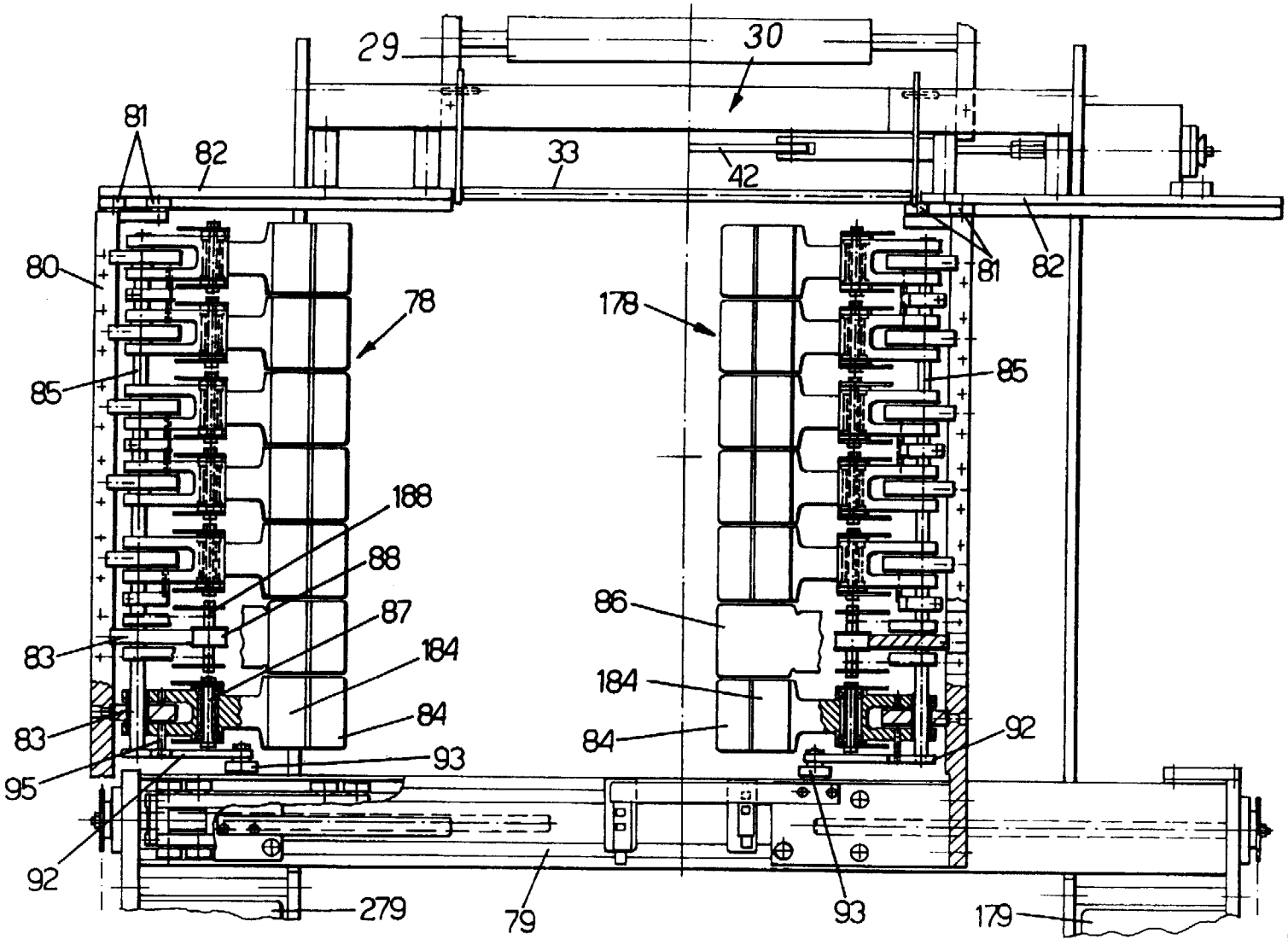
FIG. 2 is a partial plan view from above of the machine drawn in two different operating conditions.
Figure 3:
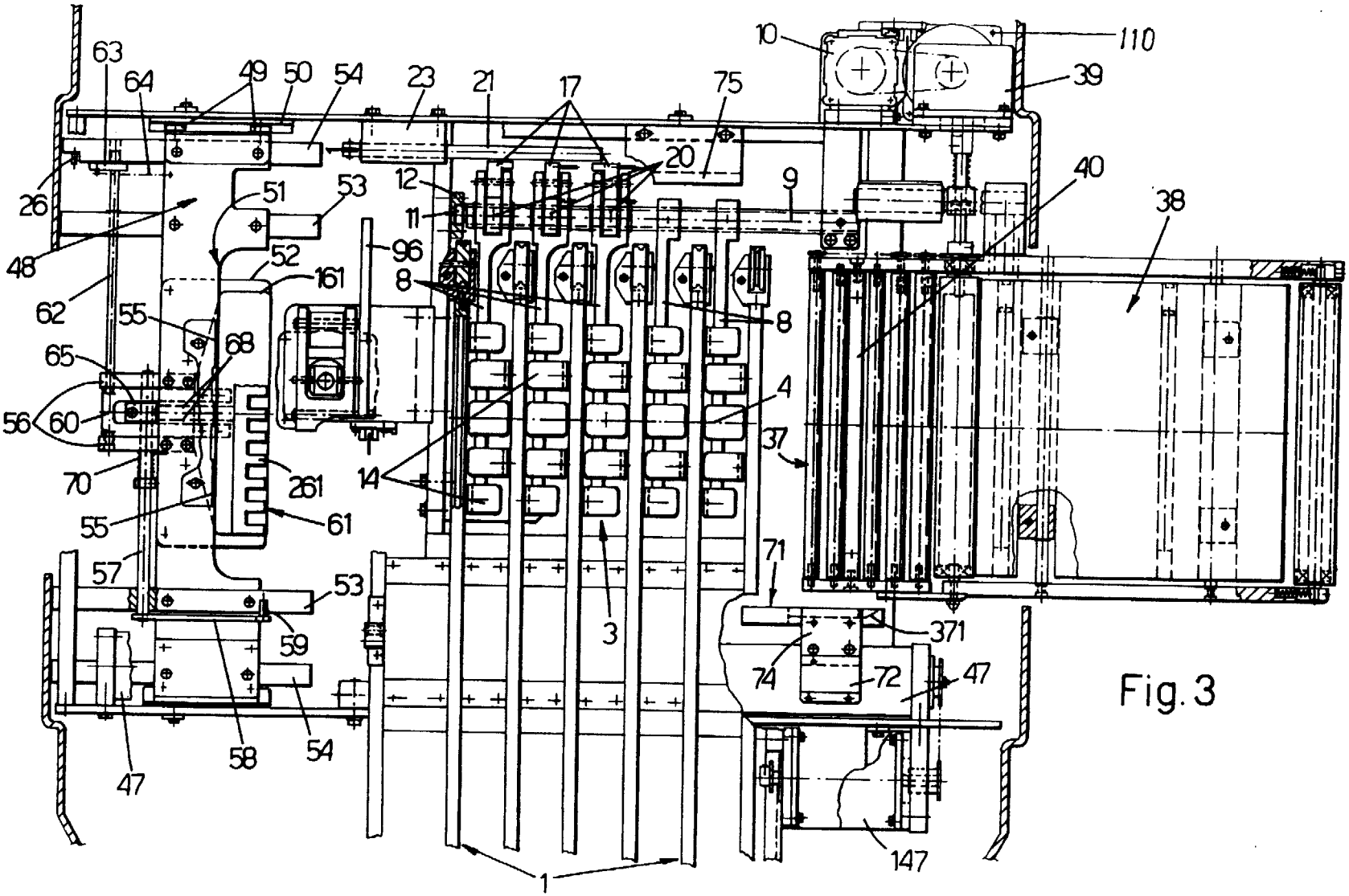
FIG. 3 is a plan view from above and partial section of the product feed assembly, the lifter assembly, the rear folder, pusher, and rear clamp assembly, and the front folder and welding conveyor assembly.
Figure 4:
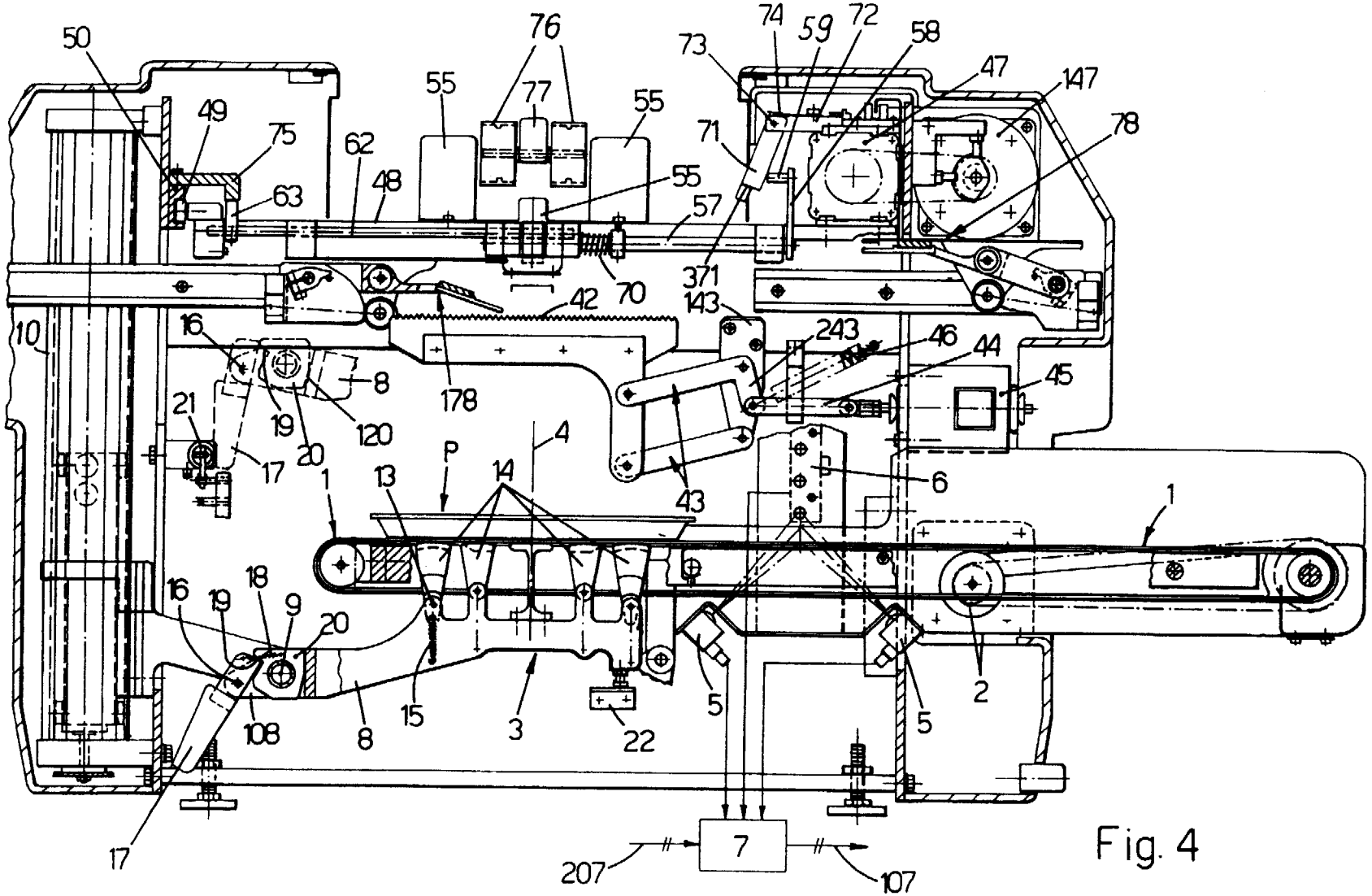
FIG. 4 shows details of the machine in section along the line IV—IV in FIG. 1, and drawn with the side clamps partly in the maximum pre-stretching position and partly in the opposite position of maximum approach to the product to be wrapped.

In FIGS. 1, 3 and 4, the reference 1 indicates the horizontal belt conveyor, with its motor 2, which feeds the products to be wrapped P to the mid-line 4 of the lifter 3 and centres them. The products P are introduced in single file and resting on the right-hand side 101 of the conveyor, where suitable presence sensors (not illustrated) may be provided. The products P are preferably orientated on the conveyor 1 with their greatest dimension lying in the transverse direction, but may be orientated differently, even randomly, owing to the machine's capability of adapting itself automatically to operation on products of different dimensions. The movement of the product on the conveyor 1 is controlled by safety devices (not illustrated) which allow one product to pass at a time, only when the lifter is in the lower position, and which automatically stop the machine when a product is not correctly disposed or has dimensions not compatible with the operating capabilities of the machine.

During the movement on the conveyor 1, the products P are scanned by at least two sets of banks 5–6 of optoelectronic sensors, which are disposed transversely both above and below the path of the product, and which, in combination with an electronic processor 7, measure the three dimensions of the product, namely the width, the height and the length (s), the last of these being deduced, given the constant value of the speed (v) of advance of the product by the conveyor 1, from the equation ($s=v\times t$), (t) being the time during which at least one of the sensors of either of the said banks 5–6 is shaded.

With its output 107 the computer 7 controls the electric motors of the driving units of the various operating mechanisms of the machine. The same computer can control the driving units of some operating mechanisms, not only with a path variable according to the dimensions and characteristics of the product to be wrapped, but also with any acceleration and deceleration which may be needed. The reference 207 indicates an optional input terminal to supply to the computer 7 any necessary variables relating to the characteristics of the product to be wrapped and/or to any characteristics of the film used.

FIG. 1 and 3 show that the conveyor 1 terminates with a comb configuration, so that the parallel brackets 8 of the lifter 3 can move within it, these brackets being fixed to and projecting from the tubular beam 9 which is external to the said conveyor 1 and is in turn fixed by one end to the vertical guiding and moving means 10, which may for example be of the type with a female thread and endless screw, the latter being driven by an electronically controlled electric motor 110 connected to the computer 7. The other end of the beam 9 is provided with a roller 11 which runs in a fixed vertical guide 12 (FIG. 3). Hinged to the brackets 8 at 13, horizontally and transversely with respect to the longitudinal axis of the conveyor 1, there are oscillating supports 14, normally kept in the vertical position by elastic means 15. With the tops of these supports, the lifter 3 is initially disposed below the upper run of the conveyor 1 so that it does not interfere with the incoming product (FIG. 1). After being centred on the mid-line 4 of the lifter 3, the product P is lifted and introduced into the wrapping point of the machine, as stated previously.

If the product is of small dimensions and does not cover the supports of one or more of the final three brackets 8 disposed in the furthest projecting part of the tubular beam 9, provision is made to neutralize these brackets automatically during the raising of the lifter, to prevent interference with the rear folder assembly located above, whose rest position varies as a function of the dimensions of the product (see below). In order to achieve this object, the final three brackets 8 are mounted rotatably on the tubular beam 9 (FIG. 4) and extend beyond it by portions 108 on each of which is pivoted at 16 a pawl 17 which, by an elastic means 18, is caused to interact at one end with the step 19 in a cam 20 fixed to the beam 9 next to each bracket 8. The other free end of the pawl 17, during the raising of the lifter, can interact with a horizontal rod 21 whose position is dependent on that of the rear folder. As a result of this interaction, the pawl 17 is disengaged from the cam 20, as shown in FIG. 4 by the broken line, and the bracket 8 in question swings downwards by gravity. The forked end of the bracket 8 which has swung on the tubular beam 9 comes to bear on the inner profile 120 of the corresponding cam 20, and the said bracket is disposed in an inclined position, such that the corresponding oscillating supports 14 do not interfere with the rear folder assembly located above (see below).

In the subsequent phase of the return of the lifter to the lower position for the start of the cycle, the brackets 8 which were previously neutralized, interact with a stop 22 which brings them back to the original horizontal position, with the pawl 17 returning to interact with the step 19 of the cam 20.

The horizontal rod 21 which causes the neutralization, if any, of the final brackets of the lifter 3 is parallel to the longitudinal axis of the machine, slides axially in a fixed guide 23, tends to move to the position of greatest extension under the action of a spring 24, and is connected by its rear end, with the interposition of a link 125, to a lever 25 which is hinged at 225 to the frame of the machine and which has its upper end disposed on the path of displacement of a stop 26 integral with the carriage of the rear folder.

The stretchable film F, for wrapping the product P, is drawn from a reel B disposed below the discharge area of the machine, supported, for example, rotatably about its own axis by a pair of parallel free-running rollers 27, and the said film F is taken around a pulley 28 and then between a pair of parallel rollers 29, at least one of which is rubber-covered and has its rotation controlled by friction means (not illustrated) regulated by the computer 7 (FIG. 4), the whole in such a way that when the film is pulled as it leaves the rollers 29 (FIG. 1) it remains longitudinally extended but substantially without longitudinal stretching.

On leaving the rollers 29 the film slides in a comb-like dispenser 30 parallel to the said rollers and supported by the frame of the machine, below the front folder 37. In particular (FIGS. 1–18), the comb 30 is formed by an upper part 130 which is supported, together with the upper part of the rollers 29, by a structure 31 pivoted at 32 on the machine frame. When this structure is temporarily lifted, overcoming the action of suitable opposing means which are not illustrated, the leading end of the film can easily be inserted between the components 29 and 30. The surfaces of the dispenser 30 in contact with the film are suitably covered with material on which the film can slide easily.

It should be understood that the means described above for feeding the film to the dispenser 30 are described purely for guidance and may be considerably modified or replaced by others with similar functions.

On leaving the comb-like dispenser 30, the film is taken around a small roller 33 parallel to the said dispenser and supported at its ends by a pair of parallel right-angled levers 34 bent downwards and pivoted at 35 on the shoulders of the support 36 on which the lower fixed part of the comb 30 is mounted or formed. Elastic means 36 push the levers 34 upwards, against fixed stops, so that the roller 33 is raised and is at a short distance from the front folder 37. During the operating cycle of the machine, the roller 33 is lowered from the position of interaction of the said levers 34 with blocks which are carried by the carriage of the rear folder and of which more will be said subsequently.

The front folder 37 (FIGS. 1–3) is formed by a plurality of horizontal coplanar rollers, parallel to each other to the aforesaid underlying rollers 29, and having a width suitably greater than that of the wrapping film. The rollers of the folder 37 are coplanar with the upper run of the next welding conveyor 38 to which they are connected by means of any suitable transmission system driven by the motor 39 (FIG. 3). The structure carrying the front folder and the conveyor 38 is fixed to the frame of the machine so that it can be lifted to allow access to the parts 29 and 30 when the leading end of the film unwound from a new reel has to be inserted between them, the whole being done in a way evident to experts in the art.

Between the rollers of the front folder 37 and immediately downstream of the dispenser 30 there is provided a parallel fixed bar 40 having a rounded upper profile and a longitudinal channel 41 (FIG. 16) which is open downwards. Under this bar and parallel to it there is provided a blade 42 with a serrated profile facing upwards, connected to means which can be caused to bring it from a lower rest position to an upper operating position, with partial insertion into the channel 41 which acts as a counter-blade. The blade 42, designed to cut the film transversely as it leaves the dispenser 30, may for example be carried by a mechanism in the form of a hinged parallelogram 43, one of whose sides 143 is vertical and fixed to the machine frame, while one of the longer sides 243 is in the form of a right-angled lever and is connected by a link 44 to a raising electromagnet 45 and to a counteracting lowering spring 46 (FIG. 4). It is to be understood that other suitable known means may be provided for the transverse cutting of the film.

In FIGS. 1, 3, 4 and 18 it can be seen that a drive unit 47, similar to the unit 10 of the lifter, is provided on the upper part of the machine, laterally with respect to the wrapping station and parallel to the longitudinal axis of the machine, the motor 147 of which drive unit is controlled by the computer 7 and the movable components of which are connected to the end of a flat horizontal carriage 48 which is parallel to the rollers of the front folder 37 and provided on the other end with rollers 49 which run in a U-shaped guide 50 parallel to the said drive unit 47 and fixed to the machine frame. The carriage 48 is provided with a recess 51 on the side facing the front folder and in this recess there projects a horizontal plate 52, with a smooth surface and with fully rounded edges, fixed to the underside of the said carriage and forming the rear folder of the wrapping film. At the end of its operating travel, the rear folder 52 is designed to run above the rollers of the front folder 37, at a short distance from these (see below).

Pairs of blocks 53-54, parallel to the drive unit 47, with wedge-shaped and downward converging ends, made of material with a low coefficient of friction, for example a suitable plastic material, are fixed on the undersides of the portions of the carriage 48 outside the area of the folder 52. One pair of these blocks, namely the inner pair 53, is aligned with the levers 34 of the oscillating roller 33 mentioned previously, to interact with the said levers and cause the lowering of the said roller. The blocks 53-54 operate on the side clamps for gripping the wrapping film, in the way described below.

The pusher 55, which pushes the product carrying tray towards the front folder 37, is fixed on the carriage 48. The pusher 55 is disposed behind the front edge of the recess 51.

A pair of supports 56 are fixed to the underside of the rear median part of the carriage 48 and hold and allow to rotate the end of a shaft 57 which is parallel to the rear folder, which passes rotatably through a block 53 and has one end reaching one side of the machine and carrying on this end a fixed lever 58 orientated upwards and provided with a lateral appendage 59 parallel to the shaft. On the portion of the shaft 57 lying between the supports 56 there is rotatably mounted the intermediate part of a fork 60 having its prongs pointing towards the front folder and supporting with these the intermediate part of the upper flat jaw 161 of the rear clamp 61 for retaining the leading end of the wrapping film (see below). On the furthest projecting part of the supports 56 there is rotatably mounted the end of a shaft 62 which is parallel to the rear folder and whose other end, near one side of the machine, is rotatably supported by a block 54 and carries a fixed lever 63 pointing upwards and backwards, with the upper end suitably rounded and connected to a tension spring 64 which tends to pull it towards the front edge of the machine. On the portion of shaft 62 lying between the supports 56 there is keyed an eccentric 65 (FIG. 18) which can interact with the transverse part of the fork 60 with profiles 165 and 265 of different eccentricity. When the lever 63 is free, the eccentric 65 interacts with the fork 60 with its profile of greater eccentricity 265 and as a result of this interaction the upper jaw 161 of the clamp 61 is raised and bears on the underside of the rear folder 52 from which it projects with a roller 66 which is parallel to the front edge of the said folder and is supported so that it can freely rotate by the ends by supports 67 fixed with their flat appendages in upper recesses of the jaw 161. On the portion of shaft 57 lying between the prongs of the fork 60 there is fixed, by its end in the form of an elastic clip, an arm 68 on whose opposite end is fixed the intermediate part of the lower jaw 261 of the clamp 61, which is characterized by a comb-like form complementary to that of the dispenser 30 and which has its upper part covered with a material suitable for retaining the leading end of the film, for example with rubber inserts. Under the rear end of the fork 60 there is fixed a leaf spring 69 which interacts with the arm 68 so as to keep the clamp 61 normally closed, with the lower jaw 261 bearing on the upper jaw 161. In FIG. 3 it will be seen that the shaft 57 is acted on by a miniature spring 70 (FIG. 3) which interacts with the carriage 48 and which tends to press the clip 61 upwards with a suitable force (see below).

In the active operating travel of the rear folder 52, as shown in FIGS. 1, 3, 4 and 15, the appendage 59 of the lever 58 is made to interact with a first inclined and descending profile 171 of a cam 71 held by an upper support 72 so that it can swing only towards the interior of the machine about a pivot 73 parallel to the longitudinal axis of the machine, in opposition to a leaf spring 74 which tends to keep the said cam in a vertical position. As a result of the interaction of the lever 58-59 with the cam 71, the lower jaw 261 of the clamp 61 is opened so that the clamp releases the rear flap of the wrapping film. When the clamp 61 has opened, the lever 63 is made to begin interacting with a fixed cam 75 which makes this lever swing backwards and which causes the profile of lesser eccentricity 165 of the eccentric 65 to interact with the fork 60, with a consequent downward swing of the clamp 61, as shown in FIG. 16. The upper jaw 161 of the clamp 61 is disposed at such a height that it can be inserted above the dispenser 30 and parallel to the latter. In FIG. 16 it can be seen that in the subsequent interaction of the lever 58-59 with the inclined and descending profile 271 of the cam 71, the lower Jaw 261 of the clamp 61 is opened in opposition to the action of the spring 69 and is positioned at a height such that the teeth of this jaw can be inserted into the apertures of the lower part 230 of the dispenser 30, under the film held by this dispenser. At the end of the active travel of the rear folder assembly, the said lever 58-59 is made to interact with a raised step 371 of the profile of the cam 71, with a consequent raising of the lever and a corresponding raising and closing of the lower jaw 261 against the upper jaw 161 of the rear clamp 61 which in this way grips the leading end of the film present in the dispenser 30. In the subsequent phase of withdrawal of the rear folder assembly, the lever 58-59 interacts with the transversely inclined edge of the step 371 of the cam 71, which is neutralized by swinging towards the interior of the machine, so that the position of the said lever is not changed and the rear clamp 61 remains closed. When the lever 58-59 leaves the cam 71, the latter, under the action of the return spring 74, returns to the active vertical position for the next cycle.

The miniature spring 70 is capable of partially compensating for the weight of the rear clamp, to simplify the action of the eccentric 65. When the lever 63 leaves the cam 75 and the eccentric interacts with the fork 60 with the profile 265 of greater eccentricity, the rear clamp 61 remains closed and returns to the high position, bearing on the underside of the rear folder 52 (FIG. 18).

In FIGS. 4 and 14 it can be seen that at the product wrapping point, above the imaginary horizontal plane on which the front fixed folder and the rear movable folder operate, there is provided a presser 76, substantially of a known type, for example with belts covered with or made of a yielding material, which acts on the product in the wrapping phase to prevent unwanted movements thereof. The presser 76 is such that it does not interact with the active parts of the pusher 55 and is connected to the machine frame by means of a hinged parallelogram joint 77, conveniently damped, which gives this component a constant horizontal position and an adequate degree of freedom on the vertical.

With reference to FIGS. 1, 2, 4, 5, 6*a* and 6*b*, the system of side clamps and folders 78-178 will now be described. This system is moved in a self-centring way by a drive unit 79 which is parallel to the conveyor i and which differs from those previously described in that it is provided with two movable mechanisms inside a single guide body, driven by corresponding endless screws, driven by corresponding motors 179–279 controlled by the computer 7.

Since the two side clamp and folder assemblies are identical, only one of them will now be described, for the sake of simplicity. One of the carriages of the drive unit 79 has fixed to it in a projecting and orthogonal configuration a flat horizontal carriage 80, disposed on edge and provided at its other end with rolling means 81 which bear on and run in a fixed guide 82 parallel to the said drive unit. On the inner side of each carriage 80, facing the product wrapping point, there are located perpendicularly the identical clamps 78-178, disposed side by side and each comprising:

- a cam 83 fixed sideways on the inner side of the said carriage 80 and having its working profile indicated by 183;
- a lower jaw 84 with its top covered with a rubber insert 184 and terminating in a forked shape which encloses the said cam to which it is pivoted at 85;
- an upper jaw 86 provided with descending lateral strips 186 pivoted at 87 to the said lower jaw and supporting and allowing to rotate, below the lower jaw, a grooved roller 88 which interacts with the profile 183 of the said cam 83. The axle 188 of the roller 88 is connected to a pair of springs 89 which pass through holes 90 formed in the carriage 80 and are connected to fixing pins 91 integral with the said carriage.

The action of the springs 89 and the form of the profile 183 of the cam 83 tend to keep the lower jaw permanently pressed upwards and bearing on the upper jaw which is disposed horizontally. The clamp is therefore normally closed, and the upper jaw is horizontal, as shown in FIG. 6*a*.

If a downward force is applied to the upper jaw 86, as shown in FIG. 6*b*, the jaw is lowered and remains horizontal for the interaction of the roller 88 with the profile 183 of the cam 83. The upper jaw approaches the pivot of the lower jaw, whose working end is withdrawn proportionally from the working end of the upper jaw, and the clamp is opened. In this phase, the profile 183 of the cam 83 is made to be such that when the clamp is open the roller 88 is pressed upwards with a small force, while the greater part of the force exerted by the springs 89 is discharged perpendicularly on the profile of the said cam, the whole in such a way that the clamp can be kept open by a small pressure.

When the clamps 78-178 are in the closed position as shown in FIG. 6*a*, they are disposed so that they are coplanar, and their upper jaws 86 are in positions at heights such that the wedge-shaped blocks 53-54 of the carriage of the rear folder assembly lie above them when this assembly is driven in its path of approach to the front folder (FIG. 19).

In FIGS. 1, 2, 4, 5, 6*a* and 6*b* it can be seen that the pivot axle 85 of the lower jaws of each row of clamps 78-178 is formed by a common shaft which has perpendicularly mounted, on the end nearer the drive unit 79, a downward pointing lever 92 provided at its end with a grooved roller 93.

The shaft 85 turns freely with respect to the clamps and has, next to each clamp, a transversely mounted finger 94 below which is transversely disposed a corresponding pin 95 fixed to and projecting from one side of the lower Jaw of each clamp. This solution permits the simultaneous control of the opening of each row of clamps with the rotation of the shaft 85 and also permits the selective opening of the clamps of each row when the lower wedge-shaped blocks of the carriage of the rear folder assembly passes over them, as stated above.

Above the said rollers 93 and along their path of travel there is provided a bar 96 parallel to the drive unit 79 and having in its intermediate part a vertical support 196, pointing downwards and connected to a hinged parallelogram structure 97 whose vertical side 197 is fixed to the machine frame. The side 297 of the parallelogram 97 is connected to a female thread 98 which interacts with a vertical screw 198 supported rotatably by fixed end supports and driven by an electric motor 99 connected to the computer 7, by means of which the said bar 96 may be raised and lowered for the controlled opening and closing of the clamps 78-178 (see below).

The machine as described operates in the following way.

The film F which is used is preferably characterized by high stretchability at least in the transverse direction, as specified in greater detail previously, and is preferably characterized in that its width is substantially equal or at least proportional to that of the products which the machine can wrap.

At the start of each operating cycle (FIG. 7), a portion of film F is held extended at the wrapping point, by the oscillating roller 33 in the high position and by the closed rear clamp 61 which, with the rear folder and the pusher, are separated from the dispenser 30 by a distance proportionate to the dimensions of the product to be wrapped, these dimensions being measured by the batteries of sensors 5 and 6 which have scanned the product during its feed by the conveyor 1. The length of the portion of film F extended at the wrapping point increases with the length of the product. By being supported on the said roller 33 which is substantially at the height of the clamp 61, the portion of film used for the wrapping is kept at the height where it can be gripped by the side clamps 78-178.

The side clamps 78-178 are withdrawn and are all opened by the action of the bar 96 on the rollers 93 of the said clamps, as described with reference to FIG. 5 and 6*b*. The clamps 78-178, which have the blocks 53-54 of the rear folder assembly lying above them, are lower than those designed to act on the film extended at the wrapping point, and therefore cannot interfere with this film, especially since they are located beyond it. In FIG. 8 it can be seen that the side clamps 78-178, which are in the withdrawn position of the start or end of a cycle as indicated by the broken line, are made to approach each other as shown by the continuous line, so that they are disposed for gripping the side edges of the film F extended at the wrapping point. As illustrated in FIG. 9, when the bar 96 in FIG. 5 is subsequently raised, the clamps 78-178 which have been initially made to approach the film F are closed, grip the film, and because of their particular structure are raised in a coplanar configuration, while the side clamps which are under the blocks of the rear folder remain in the low position and open.

From the film gripping position illustrated in FIG. 9, the side clamps are then made to undergo a self-centring movement of withdrawal from each other (FIGS. 10 and 11), to transversely stretch the film used for wrapping the product, with a degree of pre-stretching directly proportional to the dimensions of the product. During this phase, the film reacts without damage to the transverse pre-stretching, even if this is of considerable extent, a convenient quantity of film being drawn from the dispenser 30, with, if necessary, a slight approach movement of the assembly carrying the clamp 61, the whole under the control of the computer 7 which enables the various components to act in all cases in accordance with the dimensions of the product to be wrapped. By using film with suitable characteristics, mono-orientated in the longitudinal direction, for example polythene film, the pre-stretching may be increased to beyond 100% or even up to and beyond 200% of the width of the film used. The greater effects of the pre-stretching will be concentrated at the centre of the pre-stretched portion, while the peripheral parts of the portion of film will be only slightly stretched. Since these peripheral parts will subsequently be extended on to the bottom of the product, they will be prepared in the best way for being welded. The side portions F1 of film stretched by the clamps (FIG. 11) will also be joined to the remaining part of the film with a small radius of curvature of the corner areas R, with a limitation of the quantity of film which is accumulated under the corner areas of the product and which normally causes considerable problems in the phase of extension on to the bottom of the product.

After the transverse pre-stretching, the product P is raised against the pre-stretched film as illustrated in FIG. 12. In this phase, the side clamps 78-178 approach each other with a self-centring movement whose extent is proportionate to the dimensions and characteristics of the product to be wrapped, to keep the film extended over the product, while preventing unwanted compression of the product. During this phase (FIG. 11), the wrapping film bears transversely on the roller 66 of the rear folder assembly and on the first roller of the front folder 37, and, when the product is raised, reacts freely in the longitudinal direction, since it can slide longitudinally with a predetermined degree of freedom through the dispenser 30 and since the said rear clamp assembly 61 can be made to approach the wrapping point to a suitable extent, again under the control of the computer 7 which operates in accordance with the dimensions and the characteristics of the product to be wrapped.

Figure 5:
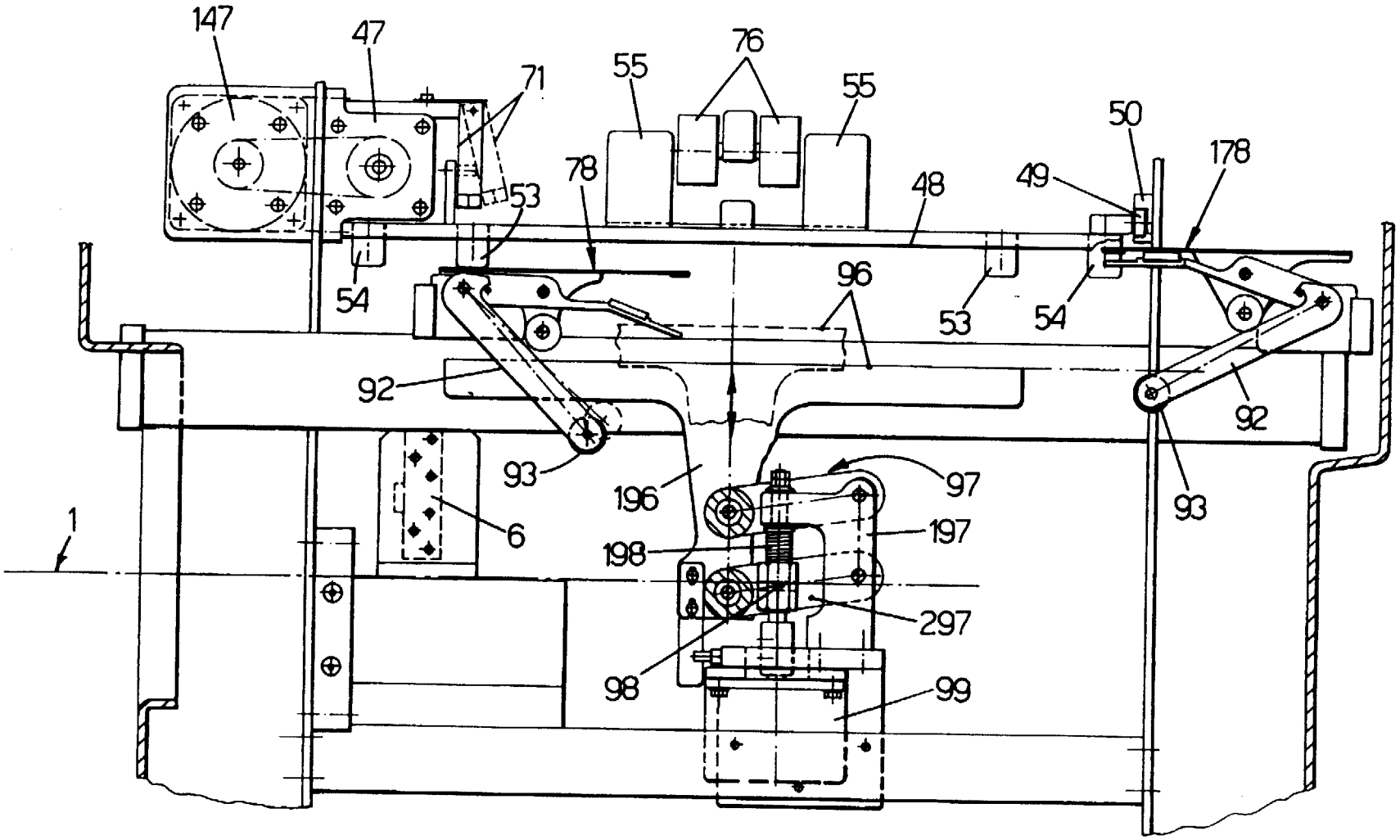
FIG. 5 shows further details of the machine drawn according to the section line V—V in FIG. 1.

In the next phase, as illustrated in FIG. 13, the side clamps 78-178, initially disposed in a closed state under the product P, are made to approach each other in a self-centring way, hocking down the oscillating supports 14 of the lifter which they encounter, and to open slightly at the correct time, with the lowering of the bar 96 in FIG. 5, to leave free the side flaps F1 of the wrapping film, so that the flaps are extended neatly on to the bottom of the product.

After the operation of the side clamps, since these effectively hold the partially wrapped product which is acted on from above by the presser 76 (FIG. 14), the lifter 3 returns to the low position.

In the next phase, as illustrated in FIG. 14, the rear folder assembly 52 is made to move in the direction of the front folder 37. The rear folder 52 with the roller 66 is inserted under the product and extends longitudinally on to the bottom of the product a part of the flap F2 of the film which is still retained by the clamp 61, while the rear of the product bears on the pusher 55 and moves with it. As a result of this movement, the product is progressively transferred on to the front folder 37 while a corresponding quantity of film F3 is drawn from the dispenser 30 and is extended longitudinally on to the bottom of the product, being placed progressively under the side flaps F1 of the wrapping film. The blocks 53-54 carried by the rear folder carriage progressively move above the side clamps 78-178 and lower them, preventing them from interfering with the rear clip 61. When the product is supported sufficiently by the front folder 37, the side clamps 78-178 are withdrawn from each other by a self-centring movement and brought to the start-of-cycle position. At the correct time, as illustrated in FIG. 15, the rear clamp 61 is made to open slightly by the action of the cam 71 and then to descend in order not to interfere with the front folder, while the flap F2 of film still retained by the rear folder 52 follows the product in the movement on to the front folder 37 and is superimposed on the flap of film F3 drawn from the dispenser 30, which is applied to the whole length of the bottom of the product and is cut to size at the correct time by the operation of the blade 42, as illustrated in FIG. 16. From the sequence of FIGS. 16 and 17 it can be seen that the oscillating roller 33 has been lowered at the correct time and the rear clamp 61 has also been lowered and opened so that it can be inserted into the dispenser 30 and then be closed in the dispenser to grip the leading end of the new wrapping film, while the product which has been wrapped is finally removed by the action of the powered rollers of the front folder 37 and the welding conveyor 38 and is temporarily stopped on this conveyor until the superimposed bottom flaps of the wrapping film have been welded. After a predetermined interval, if the machine does not discharge another wrapped product, the conveyor 38 is driven automatically to discharge the wrapped product in the cycle discussed previously.

In the subsequent movement of withdrawal of the assembly consisting of the rear clamp 61, the rear folder 52, and the pusher 55, which takes place at the correct time with the conclusion of the wrapping cycle of a product, as illustrated in FIG. 18, a new portion of film F is unreeled from the dispenser 30, to an extent proportionate to the dimensions of the new product to be wrapped, while at the correct time the roller 33 rises again and the clamp 61 also rises. The extended film does not interfere with the side clamps 78-178, since these have been laterally withdrawn at the end of the preceding cycle.

The bottom side areas of the wrapping according to the invention, indicated by 200 in FIGS. 19, 20, and 21, are formed by two superimposed layers of film, while the side areas indicated by 300 are formed by three layers. The median area in the part 100 is formed by a single layer and in the part 200 is formed by two layers of film. The final flap F3 of film which wraps the whole length of the bottom of the product is film substantially free from stretching, so that in the subsequent transfer to the welding conveyor, the superimposed flaps of the wrapping film, all less stretched, are fixed together without risk of tearing, forming a perfectly sealed closure of the wrapping. There is no reason why the temperature of the welding conveyor 38 may not be conveniently differentiated so that it is higher in the side flaps to which the portions of wrapping 200–300 are applied and lower in the median area 100–200 of the same portion of the bottom of the wrapping.

The advantages derived from the new packaging system described herein, by comparison with known systems, may be summarized as follows:

- a considerable reduction in the consumption of wrapping film, in that the portion of film initially used has a length proportionate to the dimensions of the product, since this portion of film is pre-stretched transversely for a portion of length proportionate to the length of the product to be wrapped and since the transverse pre-stretching may reach very high values;

the formation of an ideal wrapping with a portion of film highly stretched in the area superimposed on the product and with less stretched film on the bottom of the tray which contains the product;

the formation of an ideal wrapping in that the flaps of the wrapping film are extended on to the bottom of the tray in a uniform way and in a predetermined and non-random order. This condition, together with that described in the preceding item, ensure perfect welding of the bottom flaps of the wrapping film, without the risk of localized tears of the wrapping. This combination of conditions also ensures the formation of a wrapping with a perfectly sealed closure which is therefore suitable for containing products, such as pieces of meat, which may release liquids;

the machine is highly simplified in respect of construction, since the rear folder 52, the pusher 55 and the clamp 61 for gripping the leading edge of the film are mounted on a single movable unit. The side clamps 78-178 also act as side folders;

the machine does not require adjustment and may be operated without problems even by unqualified personnel, owing to the wide range of possible self-adaptation of the machine to operation on products of very different dimensions and different characteristics.

It is to be understood that the description refers to a preferred embodiment of the invention, and that numerous variations and modifications, particularly in respect of construction, may be made to this invention without thereby departing from the guiding principle of the invention, as disclosed above, as illustrated and as claimed below. In the following claims, the references in parentheses have the purpose of facilitating the reading of the claims and do not limit the scope of protection of the said claims.

We claim:

1. An apparatus for wrapping articles having different dimensions using a stretchable film comprising:

means for ascertaining length, width, and height dimensions of an article to be wrapped;

means for feeding a longitudinal segment of the stretchable film to a wrapping station, including means for determining a length dimension of the longitudinal segment to be fed to the wrapping station which is proportionate to at least the length dimension of the article determined by said ascertaining means;

means for transversely pre-stretching a selected intermediate portion of the longitudinal segment of the stretchable film, said pre-stretching means including means for selecting a desired length dimension of the intermediate portion to be pre-stretched which is proportionate to the length dimension of the longitudinal segment determined by said determining means such that the desired length dimension of the intermediate portion is also proportionate to the length dimension of the article, on each lateral side of the longitudinal segment, a respective variable length clamping means for clamping different lengths of intermediate portions in order to clamp at each lateral side the desired length dimension of the intermediate portion, means for actuating the variable length clamping means at each lateral side so that a length of the clamping means substantially equals the selected length dimension of the intermediate portion, and means for moving the respective actuated clamping means transversely away from one another to pre-stretch the intermediate portion; and means for folding the pre-stretched intermediate portion and the remainder of the longitudinal segment about the article.

2. An apparatus according to claim 1, wherein said respective variable length clamping means further comprises:

opposite longitudinal rows of clamps in the wrapping station aligned along respective lateral sides of the longitudinal segment of the stretchable film fed thereto; and means for selecting a group of said clamps of one row to be actuated together with a similar group of the other row so that each selected clamp of one row has an opposite selected clamp of the other row, said means for selecting a group including means for determining a size of the group of clamps selected which is proportionate to the length dimension determined for the article and to the length dimension of the longitudinal segment.

3. An apparatus according to claim 1, wherein said means for moving moves the clamping means so that an extent of the transverse pre-stretching is made proportionate to the desired length dimension of the intermediate portion.

4. An apparatus according to claim 1, wherein said means for moving moves the clamping means so that an extent of the transverse pre-stretching is made proportionate to the width dimension of the article.

5. An apparatus according to claim 1, wherein said means for moving moves the clamping means so that an extent of the transverse pre-stretching is made proportionate to the height dimension of the article.

6. An apparatus according to claim 1, wherein the stretchable film has a width proportionate to the width dimension of the article; and wherein said means for pre-stretching includes means for concentrating maximum stretching effects on a center portion of the intermediate portion of the longitudinal segment so that the lateral sides of the remainder of the longitudinal segment which are not pre-stretched are joined to lateral sides of the pre-stretched intermediate portion by a reduced radius of curvature.

7. An apparatus according to claim 1, wherein said means for feeding includes means for extending the longitudinal segment of the stretchable film above the article to be wrapped in the wrapping station;

wherein said means for pre-stretching includes means for reducing longitudinal tension of the longitudinal segment as a function of an extent of transverse pre-stretching accomplished by said moving means so as not to overstretch the longitudinal segment; and wherein said means for folding includes:

means for lifting said article against the prestretched intermediate portion, means for reducing the transverse pre-stretching and longitudinal tension of the longitudinal segment as a function of the dimensions of the article to avoid unwanted tensions in the longitudinal segment and unwanted pressures on the article, means for folding and extending under the article the lateral sides of the pre-stretched intermediate portion as side flaps thereof, means for folding and extending under the article and under the side flaps of the pre-stretched intermediate portion a rear flap located at a leading end of the longitudinal segment with the rear flap extending under the article only over a part of the length dimension of the article, and means for folding and extending under the article, under the side flaps and under the rear flap, a front flap located at a trailing end of the longitudinal segment which is applied over the entire length dimension of the article.

8. An apparatus according to claim 7, further comprising means for welding of the folded side flaps, rear flap and front flap together underneath the article.

9. An apparatus according to claim 7, wherein said means for folding and extending of the rear flap includes means for holding the rear flap against a bottom side of the article, and releasing the rear flap after commencing of the folding and extending of the front flap step when the rear flap is superimposed by the front flap.

10. An apparatus according to claim 7, wherein said means for folding and extending of the front flap includes means for forming the front flap from a trailing portion of the unstretched remainder of the longitudinal segment.

11. An apparatus according to claim 7, wherein said means for extending the longitudinal segment above the article includes means for extending the longitudinal segment longitudinally from a feed reel of the stretchable film without pre-stretching the longitudinal segment longitudinally, and means for holding the trailing end of the extended longitudinal segment movably; and wherein said means for reducing longitudinal tension includes means for holding the leading end slidably under tension so that the longitudinal tension is reduced during pre-stretching as well as during said lifting step proportionally to the extent of the transverse pre-stretching of the intermediate portion.

12. An apparatus according to claim 11, wherein said means for folding and extending of the front flap includes means for separating the trailing edge from a remaining film of the feed reel so as to provide a new leading end of the remaining film to be used in conjunction with a subsequent wrapping process.

13. An apparatus according to claim 8 wherein said means for folding and extending of the front flap includes means for moving the enfolded article to a welding station where said means for welding is located.

14. A machine for wrapping products with stretchable film comprising:

means for ascertaining length, width, and height dimensions of an article to be wrapped;

means for feeding a longitudinal segment of the stretchable film to a wrapping station, including at least one reel for feeding the film and means for determining a length dimension of the longitudinal segment to be fed to the wrapping station which is proportionate to at least the length dimension of the article determined by said ascertaining means;

means for holding, at a product wrapping point, a longitudinal segment of the film, which is extended but not substantially stretched, said holding means comprising a fixed front dispenser disposed next to a front fixed folder capable of allowing the film to slide through said front fixed folder only when a specified longitudinal tensile force is exceeded so that the film remains longitudinally extended, a rear clamp parallel, complementary and opposite to said dispenser and mounted against a carriage which carries a movable rear folder, and a computer which controls a movement of said rear clamp towards and away from said front dispenser wherein a travel distance of said rear clamp is proportionate to at least one of length, width, height dimensions of the product to be wrapped;

means for transversely pre-stretching a selected intermediate portion of a longitudinal segment of the stretchable film, said pre-stretching means including means for selecting a desired length dimension of the intermediate portion to be pre-stretched which is proportionate to the length dimension of the longitudinal segment determined by said determining means such that the desired length dimension of the intermediate portion is also proportionate to the length dimension of the product, on each lateral side of the longitudinal segment, a respective variable length clamping means for clamping different lengths of intermediate portions in order to clamp at each lateral side the desired length dimension of the intermediate portion, means for actuating the variable length clamping means at each lateral side so that a length of the clamping means substantially equals the selected length dimension of the intermediate portion, and means for moving the respective actuated clamping means transversely away from one another to pre-stretch the intermediate portion;

said variable length clamping means comprising opposing clamps disposed to grip the lateral sides of film extended at the wrapping point, each said clamp being disposed next to at least one adjacent said clamp, means for rectilinear and self-centering movement of said clamps;

elastic means for closing said clamps and a centralized operating system for opening said clamps, and means for causing said clamps not used for gripping the film by the variable length clamping means to be disposed at a lower height than an assembly comprising said rear folder and said rear clamp;

means for reducing longitudinal tension in the film, during the pre-stretching phase, with a proportional approach of the rear clamp which holds a rear flap of the film and with a proportional drawing of film from said fixed front dispenser;

a lifter located at the wrapping point and capable of lifting the product to be wrapped against the film which is held by said holding means and which bears a front of said film on a rear face of the front fixed folder and a rear of said film on a support which allows the film to slide freely, wherein said opposing clamps are able to approach each other to a distance proportionate to the dimensions of the product as the product is lifted, while the longitudinal tension of the film is reduced with a suitable approach of said rear clamp and with a proportionate drawing of film from the feed dispenser;

movable folding means for executing folding of side flaps onto the bottom of the product, said side flaps being formed by transverse pre-stretching of the film and held by the respective variable length clamping means, the rear folder being made to operate and extend a portion of a rear flap of the film under the product and under a portion of said side flaps, while the film remains fixed to said rear clamp;

a pusher, mounted on a carriage which also carries the rear folder immediately after the rear folder which pushes the product onto the front fixed folder while a front flap of film is drawn under tension from said fixed front dispenser and extended onto an entire bottom length of the product; and cutting means for separating the front flap of the wrapping film transversely from a new leading end of the film held by said dispenser.

15. A machine according to claim 14, further comprising:

means for feeding to the lifter the product to be wrapped such that said means for ascertaining dimensions of the product acts when the product is placed on the lifter;

means for determining as a function of said dimensions, the operation of the assembly;

a presser which prevents unwanted movements of the product when the wrapping film is progressively released by the opposing clamps and the rear clamp and is finally detached from the dispenser; and means for welding said flaps of the wrapping film onto the bottom of the product.

16. A machine according to claim 14, wherein the fixed front dispenser is disposed below the front fixed folder and is formed by a fixed lower part, an upper part which can be raised from said lower part, and folder elastic means for biasing said upper and lower parts in opposition to the raising of said upper part; and further comprising at least one pair of parallel superimposed rollers such that the leading end of the film unreeled from a new reel can be easily inserted therebetween, wherein at least one roller is connected to means for creating friction such that the film can be drawn from the dispenser only when a specified longitudinal tensile force is exceeded.

17. A machine according to claim 16, wherein the cutting means further comprise a grooved counter-blade fixed between the rollers of the front fixed folder, parallel to said rollers and below and opposite a serrated blade.

18. A machine according to claim 16, wherein the front fixed folder further comprises a plurality of free-running rollers which are parallel to each other and transverse with respect to a direction of advance of the product leaving the said folding means, said free-running rollers being mounted on a structure which carries the welding means to which said free-running rollers are mechanically connected, the motion of the free-running rollers being provided by a single motor.

19. A machine according to claim 18, wherein said structure is connected to a machine frame structure to allow access to the fixed front dispenser and the friction means for insertion therebetween of a leading end of the film unreeled from a new reel.

20. A machine according to claim 14, further comprising levers which are hinged at sides of said fixed front dispenser and move upward under the action of said elastic means and respective second rollers rotatably carried by respective said levers at an end parallel to the dispenser, said second rollers being disposed under the film leaving the dispenser and normally disposed in front of the front fixed folder to keep the film extended at the wrapping point and held by the rear clamp associated with the rear folder in a substantially horizontal position and at a height so as to be gripped by the variable length clamping means.

21. A machine according to claim 14, wherein the rear folder has a flat shape, smooth surfaces and rounded edges.

22. A machine according to claim 14, further comprising a pair of supports fixed on said carriage and a fork, having prongs, said fork being rotatably mounted on said supports, wherein said fork interacts with an eccentric keyed to the end of a shaft which is supported rotatably by said supports parallel to the carriage, wherein said carriage is fixed to a first lever which is connected to a carriage elastic means for biasing the carriage so that said eccentric tends normally to be disposed in a position of maximum eccentricity and to keep an upper jaw of the rear clamp raised and bearing on an underside of the rear folder so that when the carriage is reaching an end of approaching travel to the front fixed folder, said lever interacts with a fixed cam which causes rotation of said eccentric into a position of lesser eccentricity so that the upper jaw of the rear clamp is lowered and prepared for interaction with the film dispenser; a second lever, disposed within said fork, fixed on an end of the shaft which forms a pivot for the upper jaw, supporting a lower jaw of the rear clamp and tending to rise under the action of a leaf spring fixed to said fork, wherein said shaft forms the pivot of the rear clamp and extends to one side of the carriage which supports the rear clamp, wherein said shaft is supported rotatably and carries a third lever pointing upwards which, when the carriage is reaching the end of the travel of approach to the front fixed folder, interacts with a lever cam which initially causes partial lowering of the lower jaw when the upper jaw is still raised with consequent pre-opening of the rear clamp which releases the rear flap of the film, after which, when the upper jaw has been lowered, said lever cam causes lowering of the lower jaw necessary to enable the rear clamp to enter in an open state into the dispenser, after which said lever cam ceases to act and the lower jaw is closed elastically on the upper jaw clamping the film disposed in the dispenser, so that when said first lever operating the eccentric releases the fixed cam and the eccentric is disposed in the position of greater eccentricity, the closed rear clamp is raised and brought to bear on the underside of the rear folder.

23. A machine according to claim 22, wherein the lever cam is mounted on a cam support parallel to a longitudinal axis of the machine in opposition to a lever elastic means for biasing the third lever so that, when the third lever is released by the lever cam, the lever cam presents behind the third lever a transversely inclined face, so that in subsequent return travel of the rear clamp, the third lever passes laterally across the lever cam which is neutralized by swinging laterally in opposition to said lever elastic means and when released from the third lever, returns to an active position for a next cycle.

24. A machine according to claim 22, wherein the shaft is subjected to a miniature spring which partially compensates for the weight of the rear clamp to simplify the operation of the eccentric which modifies the position of the rear clamp with respect to the height of the product.

25. A machine according to claim 14, wherein the opposing clamps are fixed to corresponding supporting carriages connected to said self-centering movement means by a hinged, substantially parallelogram-type structure, so that the upper jaw always remains horizontally disposed; and further including jaw elastic means for biasing the jaws of each opposing clamp to rise into the closed position wherein the raising of the opposing clamp is impeded by the bearing of the lower jaw on the upper jaw.

26. A machine according to claim 22, wherein each opposing clamp comprises a carriage cam fixed to and projecting from an inner side of the carriage which supports each set of opposing clamps; a lower jaw hinged with a forked end to said carriage cam; and an upper jaw provided with downward projecting side lugs, which said side lugs are pivoted at a second pivot to an intermediate part of the lower jaw and which carry under the second pivot a free-running grooved roller which interacts with said carriage cam, springs being fixed on first ends of an axle of said free-running groove roller and said axle being connected at second ends to said carriage to maintain the interaction between the free-running groove roller and the carriage cam.

27. A machine according to claim 26, wherein the carriage carries transverse wedge-shaped blocks which, during the movement of said carriage interact with the upper jaws of the opposing clamps to lower the opposing clamps to prevent the opposing clamps from interfering with the rear clamp mounted on the carriage.

28. A machine according to claim 26, wherein a hinge of the lower jaws of each set of opposing clamps is formed by a second shaft supported rotatably by the carriage cams, the second shaft being free with respect to the lower jaws and having transversely fixed fingers disposed on a side of each opposing clamp and above corresponding pins fixed to and projecting from one of the prongs of the forked end of each opposing clamp, said second shaft having an integral lever which said lever is fitted on one end at a right angle to said second shaft and which said lever has at another end a grooved roller which runs under a rectilinear horizontal bar connected to said means for moving, said moving means comprising a hinged parallelogram-type structure, a driving servo mechanism, and an electric motor controlled by the computer.

29. A machine according to claim 14, wherein the lifter is provided with oscillating supports kept in a raised position by lifter elastic means for raising said oscillating supports and being knocked down by interference with the lower jaw of the opposing clamps, some of the oscillating supports forming a first row close to the rear folder and being mounted on brackets which can swing on a tubular beam, each bracket carrying, hinged to an extension, a pawl which has an end facing said beam orientated upwards and interacting with a pawl cam fixed on said beam to keep said bracket in a normally horizontal position; and further including means for varying the position of a horizontal guided rod which during the raising of the lifter can interact with said pawls to cause the downward swing of the brackets which, with the corresponding oscillating supports, must not interfere with said rear folder, any brackets which are neutralized being made to interact, in subsequent downward travel of the lifter, with fixed stops which return said neutralized brackets to the horizontal position, with the pawl which returns to interact by a snap movement with the corresponding pawl cam.

30. A machine according to claim 14, further comprising at least one bank of optoelectronic sensors which measure length, width and height data of the product to be wrapped, and which send said data to the computer to control withdrawal and advance of the assembly, as well as the approach to and withdrawal from each other of said opposing clamps for transverse pre-stretching and folding of the side flaps of the film.

* * * * *